US012704055B2

(12) United States Patent
Singh et al.

(10) Patent No.: US 12,704,055 B2
(45) Date of Patent: Aug. 11, 2026

(54) TRANSMISSION FAILURE PREDICTION BY LEVERAGING A PRODUCTION IMPACT EVALUATION METRIC

(71) Applicant: Halliburton Energy Services, Inc., Houston, TX (US)

(72) Inventors: Lokesh Pratap Singh, Bangalore (IN); Yogendra Singh, Bangalore (IN); Feng Feng, Houston, TX (US); Fahad Ahmad, Houston, TX (US); Yanmei Li, Houston, TX (US); Gonzalo Federico Llanos, Houston, TX (US); Gonzalo Martín Irusta, Neuquen (AR); Bo Liang, Houston, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 455 days.

(21) Appl. No.: 18/511,180

(22) Filed: Nov. 16, 2023

(65) Prior Publication Data

US 2025/0163789 A1 May 22, 2025

(51) Int. Cl.
*E21B 43/26* (2006.01)
*E21B 47/12* (2012.01)

(52) U.S. Cl.
CPC ..... *E21B 43/2607* (2020.05); *E21B 47/12* (2013.01)

(58) Field of Classification Search
CPC .. E21B 43/2607; E21B 47/12; E21B 2200/20; E21B 2200/22
See application file for complete search history.

(56) References Cited

U.S. PATENT DOCUMENTS 9,964,202 B2 5/2018 Macik
2007/0140869 A1* 6/2007 St. Michel ..... F04B 49/22 417/63

(Continued)

FOREIGN PATENT DOCUMENTS

CA 2909247 C 10/2017
CN 111709577 A 9/2020

(Continued)

OTHER PUBLICATIONS

Foreign Communication from Related Application—International Search Report and Written Opinion of the International Searching Authority, International Application No. PCT/US2023/081881, dated Jul. 31, 2024 10 pages.

*Primary Examiner* — Shelby A Turner
*Assistant Examiner* — Yaritza H Perez Bermudez
(74) *Attorney, Agent, or Firm* — Conley Rose, P.C.; Rodney B. Carroll

(57) ABSTRACT

Systems and methods are described for scheduling reciprocating fracturing pump transmission maintenance. Accelerometers recording spectra are coupled to the transmission, and spectra with timestamps are collected at a fixed time interval. From each spectra is generated statistical and characteristic frequency (CF) features. The statistical and CF features of each spectra where the pump is idle are removed; processed features are retained. Joined features are created by joining the processed features with time domain features, and then input into an anomaly detection model (ADM) that identifies at least one outlier data point in the joined features indicating a probability a failure of the transmission. A failure alert is generated and ranked produce a production impact score (PIS) based at least on the probability of the failure of the transmission being beyond a (Continued)

failure threshold. Based on the PIS, a remediation procedure is scheduled before a catastrophic transmission failure.

20 Claims, 19 Drawing Sheets

(56) References Cited

U.S. PATENT DOCUMENTS

| | | | | |
|---|---|---|---|---|
| 2010/0102976 | A1* | 4/2010 | Lee | G01H 1/003 73/659 |
| 2010/0300683 | A1* | 12/2010 | Looper | E21B 47/008 166/250.01 |
| 2015/0377318 | A1* | 12/2015 | Bymne | F04B 17/05 700/282 |
| 2018/0038216 | A1* | 2/2018 | Zhang | G01L 5/0071 |
| 2020/0208628 | A1* | 7/2020 | Sigmar | F04C 11/008 |
| 2021/0301815 | A1* | 9/2021 | Chretien | F04B 51/00 |
| 2022/0260985 | A1 | 8/2022 | Gabaldon et al. | |
| 2023/0235736 | A1* | 7/2023 | Yeung | G01L 5/0061 417/18 |
| 2023/0392592 | A1* | 12/2023 | Shampine | E21B 43/2607 |
| 2024/0068349 | A1* | 2/2024 | Talya | E21B 44/00 |

FOREIGN PATENT DOCUMENTS

| | | | |
|---|---|---|---|
| CN | 114861349 | A | 8/2022 |
| DE | 10015027 | B4 | 11/2006 |

* cited by examiner

1200

1st GEAR

| T_wi | P1_GMF (Hz) | P3_GMF (Hz) | T_wo | P1_GMF/T_wo | P3_GMF/T_wo |
|---|---|---|---|---|---|
| 700 | 0 | 239.56 | 186.67 | 0 | 1.283334226 |
| 1450 | 0 | 496.22 | 366.67 | 0 | 1.283316523 |
| 1950 | 0 | 667.33 | 520 | 0 | 1.283326923 |
| 2000 | 0 | 684.44 | 533.33 | 0 | 1.283333021 |

1st GEAR RATIO: 3.750023

2nd GEAR

| T_wi | P1_GMF (Hz) | P3_GMF (Hz) | T_wo | P1_GMF/T_wo | P3_GMF/T_wo |
|---|---|---|---|---|---|
| 700 | 466.67 | 333.5 | 259.87 | 1.795782507 | 1.283333975 |
| 1450 | 966.67 | 690.82 | 538.3 | 1.795783021 | 1.28333643 |
| 1950 | 1300 | 929.03 | 723.92 | 1.795778539 | 1.283332412 |
| 2000 | 1333.33 | 952.85 | 742.48 | 1.795779011 | 1.283334231 |

2nd GEAR RATIO: 2.693675

3rd GEAR

| T_wi | P1_GMF (Hz) | P2_GMF (Hz) | P3_GMF (Hz) | T_wo | P1_GMF/T_wo | P2_GMF/T_wo | P3_GMF/T_wo |
|---|---|---|---|---|---|---|---|
| 700 | 0 | 191.01 | 178.27 | 317.98 | 0 | 0.600698157 | 0.560632744 |
| 1450 | 0 | 395.66 | 369.28 | 658.68 | 0 | 0.600686221 | 0.560636424 |
| 1950 | 0 | 532.09 | 496.62 | 885.81 | 0 | 0.600681682 | 0.560639415 |
| 2000 | 0 | 545.74 | 509.35 | 908.53 | 0 | 0.600684622 | 0.560630909 |

3rd GEAR RATIO: 2.201

4th GEAR

| T_wi | P1_GMF (Hz) | P3_GMF (Hz) | P4_GMF (Hz) | T_wo | P1_GMF/T_wo | P3_GMF/T_wo | P4_GMF/T_wo |
|---|---|---|---|---|---|---|---|
| 700 | 0 | 142.11 | 185.45 | 395.48 | 0 | 0.359335491 | 0.468923839 |
| 1450 | 0 | 294.37 | 384.15 | 819.21 | 0 | 0.359332912 | 0.468928022 |
| 1950 | 0 | 395.88 | 516.62 | 1101.69 | 0 | 0.359334937 | 0.468930664 |
| 2000 | 0 | 406.03 | 529.86 | 1129.94 | 0 | 0.359334447 | 0.468930025 |

4th GEAR RATIO: 1.770

*FIG. 12A*

1200

5th GEAR

| T_wi | P1_GMF (Hz) | P2_GMF (Hz) | P3_GMF (Hz) | T_wo | P1_GMF/T_wo | P2_GMF/T_wo | P3_GMF/T_wo |
|---|---|---|---|---|---|---|---|
| 700 | 466.67 | 265.91 | 248.19 | 442.68 | 1.054182408 | 0.600682594 | 0.560637088 |
| 1450 | 966.67 | 550.82 | 514.10 | 916.99 | 1.054178514 | 0.600682594 | 0.560637088 |
| 1950 | 1300 | 740.76 | 691.37 | 1233.19 | 1.054174879 | 0.600682594 | 0.560637088 |
| 2000 | 1333.33 | 759.75 | 709.10 | 1264.81 | 1.054172243 | 0.600682594 | 0.560637088 |

5th GEAR RATIO: 1.581

6th GEAR

| T_wi | P1_GMF (Hz) | P3_GMF (Hz) | P4_GMF (Hz) | T_wo | P1_GMF/T_wo | P3_GMF/T_wo | P4_GMF/T_wo |
|---|---|---|---|---|---|---|---|
| 700 | 466.67 | 197.55 | 258.21 | 551.18 | 0.846672714 | 0.358418301 | 0.468463458 |
| 1450 | 966.67 | 409.22 | 534.86 | 1141.73 | 0.846669586 | 0.358418301 | 0.468463458 |
| 1950 | 1300 | 550.33 | 719.29 | 1535.43 | 0.846666667 | 0.358418301 | 0.468463458 |
| 2000 | 1333.33 | 564.44 | 737.74 | 1574.80 | 0.84666455 | 0.358418301 | 0.468463458 |

6th GEAR RATIO: 1.270

7th GEAR

| T_wi | P1_GMF (Hz) | P2_GMF (Hz) | P3_GMF (Hz) | T_wo | P1_GMF/T_wo | P2_GMF/T_wo | P3_GMF/T_wo |
|---|---|---|---|---|---|---|---|
| 700 | 0 | 0 | 0 | 700.00 | 0 | 0 | 0 |
| 1450 | 0 | 0 | 0 | 1450.00 | 0 | 0 | 0 |
| 1950 | 0 | 0 | 0 | 1950.00 | 0 | 0 | 0 |
| 2000 | 0 | 0 | 0 | 2000.00 | 0 | 0 | 0 |

7th GEAR RATIO: 1.000

8th GEAR

| T_wi | P1_GMF (Hz) | P2_GMF (Hz) | P3_GMF (Hz) | T_wo | P1_GMF/T_wo | P2_GMF/T_wo | P3_GMF/T_wo |
|---|---|---|---|---|---|---|---|
| 700 | 466.67 | 0 | 0.00 | 974.51 | 0.478876564 | 0 | 0 |
| 1450 | 966.67 | 0 | 0.00 | 2018.63 | 0.478874286 | 0 | 0 |
| 1950 | 1300 | 0 | 0.00 | 2714.71 | 0.478872513 | 0 | 0 |
| 2000 | 1333.33 | 0 | 0.00 | 2784.31 | 0.478872683 | 0 | 0 |

8th GEAR RATIO: 0.718 0.754226
0.682395

*FIG. 12B*

1300

| GEAR | FIRST PLANETARY GEAR ENGAGED? | SECOND PLANETARY GEAR ENGAGED? | THIRD PLANETARY GEAR ENGAGED? | FOURTH PLANETARY GEAR ENGAGED? |
|---|---|---|---|---|
| 1 1302 | YES, WORKING AS FIXED GEAR (NO CF) | NO | YES | NO |
| 2 1304 | YES | NO | YES | NO |
| 3 1306 | YES, WORKING AS FIXED GEAR (NO CF) | YES | YES | NO |
| 4 1308 | YES, WORKING AS FIXED GEAR (NO CF) | NO | YES | YES |
| 5 1310 | YES | YES | YES | NO |
| 6 1312 | YES | NO | YES | YES |
| 7 1314 | YES, WORKING AS FIXED GEAR (NO CF) | YES, WORKING AS FIXED GEAR (NO CF) | YES, WORKING AS FIXED GEAR (NO CF) | NO |
| 8 1316 | YES | YES, WORKING AS FIXED GEAR (NO CF) | YES, WORKING AS FIXED GEAR (NO CF) | NO |

*FIG. 13*

TRANSMISSION FAILURE PREDICTION BY LEVERAGING A PRODUCTION IMPACT EVALUATION METRIC

BACKGROUND

High-pressure pumps having reciprocating elements such as plungers or pistons are commonly employed in oil and gas production fields for operations such as drilling and well servicing. For instance, one or more reciprocating pumps may be employed to pump fluids into a wellbore in conjunction with activities including fracturing, acidizing, remediation, cementing, and other stimulation or servicing activities. Due to the harsh conditions associated with such activities, many considerations are generally considered when designing a pump for use in oil and gas operations. One design consideration concerns the life and reliability of transmissions used to transfer power from a power source such as an engine or motor to a pump configured to move fracturing fluid at high pressure.

Unexpected sudden catastrophic transmission failures lead to loss of production time and often leads to a complete overhaul or replacement of the transmission. Unexpected (and therefore unplanned for) overhaul or replacement of the transmission causes additional loss of production time. Contemporary, previously used methods to predict catastrophic transmission failures before they occur are highly manual and predict only certain types of failures.

BRIEF DESCRIPTION OF THE DRAWINGS

For a more complete understanding of the present disclosure, reference is now made to the following brief description, taken in connection with the accompanying drawings and detailed description, wherein like reference numerals represent like parts.

FIGS. 12A and 12B are tabular views illustrating an exemplary characteristic frequency calculation using planetary gears under various gears of a transmission according to an embodiment of the disclosure.

FIG. 13 is a tabular view illustrating an exemplary engagement and disengagement of planetary gears of a transmission according to an embodiment of the disclosure.

DETAILED DESCRIPTION

Figure 1:
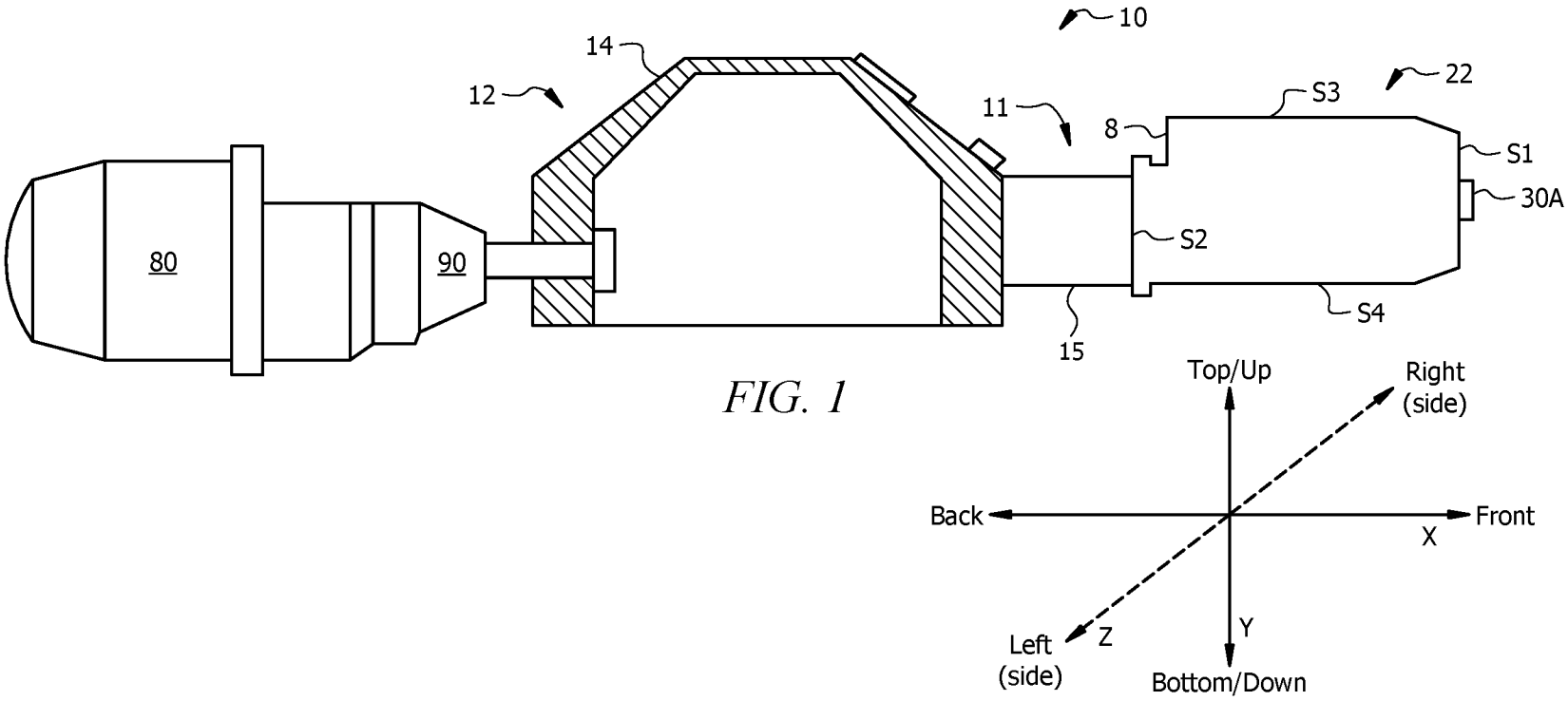
FIG. 1 is a side elevational view illustrating a pump according to an embodiment of the disclosure.

It should be understood at the outset that although illustrative implementations of one or more embodiments are illustrated below, the disclosed systems and methods may be implemented using any number of techniques, whether currently known or not yet in existence. The disclosure should in no way be limited to the illustrative implementations, drawings, and techniques illustrated below, but may be modified within the scope of the appended claims along with their full scope of equivalents.

The present disclosure is directed to pumping units used in oilfield servicing operations to pump a treatment fluid downhole. Non-limiting examples of suitable pumps include, but are not limited to, piston pumps, plunger pumps, and the like. In embodiments, the pump is a rotary- or reciprocating-type pump such as a positive displacement pump operable to displace pressurized fluid. The pump comprises a pump power end, a pump fluid end, and an integration section whereby a reciprocating element (e.g., a plunger) can be mechanically connected with the pump power end such that the reciprocating element can be reciprocated within a reciprocating element bore of the pump fluid end.

The present disclosure generally relates to at least predicting a failure of a transmission within a pump employed in oil and gas production field for drilling and well servicing operations. More particularly, embodiments are directed to at least using a trained machine learning (ML) model utilizing historical data and feature generation techniques to predict a catastrophic failure of a monitored transmission before an actual failure occurs.

Some embodiments discussed herein, upon receiving a failure alert generated by the ML model, utilize a production impact score calculation in combination with a failure threshold to determine whether to schedule a remediation procedure. The production impact score quantifies how the remediation procedure will impact production. In some embodiments, the production impact score is higher (indicating a higher production impact) based on the amount of time that the pump must be offline to complete the remediation procedure. In some embodiments, during this time, the pump is not producing oil, gas, or other marketable products, and the production impact score at least partially quantifies the lost profit associated with not having these products available to sell. In such embodiments, the production impact score is based at least in part on the probability of the failure of the transmission being beyond a failure threshold. In some such embodiments, if the probability of the failure of the transmission is, for example, sixty-five percent, and the failure threshold defines an unacceptable likelihood of failure as at least thirty-three percent, the value of the production impact score quantifies that the production impact of conducting a remedial procedure on the transmission is sufficiently lower than the impact on production of a catastrophic failure that is sixty-five percent likely to occur to schedule a remediation procedure before the predicted catastrophic failure occurs. In some such embodiments, the cost of the remediation procedure is known, and the cost of repairing or replacing the pump in the event of a catastrophic failure are known, and these factors are utilized when computing the production impact score or defining the failure threshold.

The disclosed systems and methods operate in an unconventional way to predict the failure of a transmission associated with a pump by leveraging the presence of planetary gears within the pump to conduct failure predictions based on an ML model. A transmission utilizing planetary gears sets the currently active gear (e.g., first gear, second gear, and so on through however many gears particular a transmission possesses) through engaging and disengaging the planetary gears in various combinations. That is, as explained further below, as a non-limiting example, a first combination of engaged and disengaged planetary gears corresponds to a first gear, and a second combination of engaged and disengaged planetary gears corresponds to a second gear.

The ML model disclosed herein predicts transmission failure based in part on using sensor data to identify the presence of certain characteristic frequencies (CFs, or individually, a CF) generated by the meshing of each of the planetary gears within a transmission, where the presence of these certain CFs is an indicator of a likelihood of transmission failure which is usable by the ML model to produce a failure prediction. Each of the CFs is calculated based at least in part on a known gear mesh frequency (GMF) of a particular planetary gear and a current revolutions per minute (RPM) value of the transmission. Additional factors usable by the ML model include but are not limited to features of measured spectra amplitude and time domain features. Features of measured spectra amplitude include but are not limited to characteristics of a measured spectra such as: mean, kurtosis, skewness, and crest factor. Time domain features include but are not limited to data measurable at a moment in time by sensors communicatively coupled to a transmission and associated components, such as: engine or motor RPM, pressure, oil temperature, and torque. Based on a predicted failure of a transmission, the ML model enables scheduling a remedial procedure to mitigate the conditions likely to cause the catastrophic failure of the transmission before the catastrophic failure of the transmission occurs.

Some disclosed systems and methods operate in an additional unconventional way by combining a prediction of with the production impact score and using the production impact score to constrain the scheduling of the remedial procedure such that the value of the production impact score quantifies that the production impact of conducting a remedial procedure on the transmission is sufficiently lower than the production impact of a catastrophic failure of the transmission predicted to occur with a specific degree of certainty (e.g., sixty-five percent likely to occur). Utilizing the production impact score as described enables scheduling remediation procedures only when doing so is determined to have less of an impact on production than not doing so, as discussed in further detail elsewhere herein.

In such systems and methods where the production impact score is utilized as a constraint on scheduling remediation procedures, the production impact score is calculated based on a number of factors. These include but are not limited to: a predicted point of failure of the transmission being analyzed by the ML model, an actual failure point (e.g., of a known similar transmission operating under similar circumstances), and a mean running life of the transmission being analyzed by the ML model. In embodiments where the production impact score is represented as a financial cost savings metric (e.g., the cost to conduct a remediation procedure versus the cost to replace the transmission in the event of catastrophic failure), the production impact score is further based on additional factors including the cost of a total overhaul of the transmission, the cost of a general repair of the transmission, and other similar known costs of various types of repairs, replacements, and remediations.

The systems and methods described herein operate on measured data collected from wells within a reservoir, such as those found in oil and gas production fields. Such fields generally include multiple producer wells that provide access to the reservoir fluids underground. Measured well data is collected regularly from each producer well to track changing conditions in the reservoir.

Figure 2A:
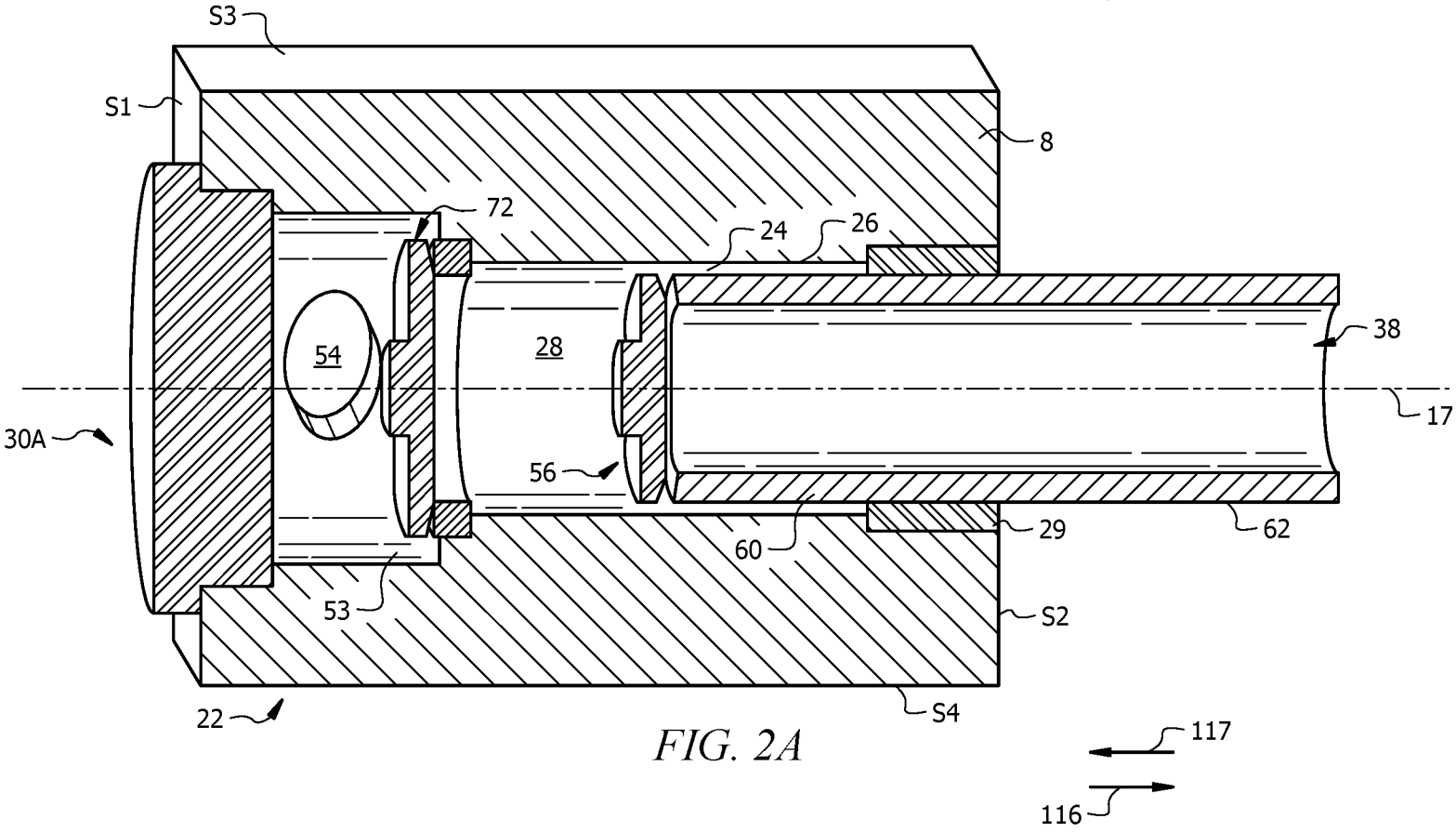
FIG. 2A is a cut-away view illustrating an exemplary pump comprising a concentric bore pump fluid end according to an embodiment of the disclosure.

FIG. 1 shows a side elevational view illustrating a pump 10 according to an embodiment of the disclosure. For convenience, FIG. 1 is discussed herein in conjunction with discussion of FIG. 2A, is a cut-away view illustrating an exemplary reciprocating pump comprising a concentric bore pump fluid end according to an embodiment of the disclosure, and FIG. 2B, a cut-away view illustrating an exemplary reciprocating fracturing pump comprising a cross-bore (referred to as a "tee-bore" or "T-bore" herein) pump fluid end according to an embodiment of the disclosure.

In some embodiments, the pump 10 is a reciprocating pump. The reciprocating pump 10 comprising a pump power end 12, a pump fluid end 22, and an integration section 11. As illustrated in FIG. 1, the pump fluid end 22 has a front S1 opposite a back S2 along a first or x-axis, a top S3 opposite a bottom S4 along a second or y-axis, wherein the y-axis is in the same plane as and perpendicular to the x-axis, and a left side and a right side along a z-axis, wherein the x-axis is along a plane perpendicular to the plane of the x-axis and the y-axis. Accordingly, toward the top of the pump fluid end 22 (and the pump 10) is along the y-axis toward top S3, toward the bottom of the pump fluid end 22 (and the pump 10) is along the y-axis toward bottom S4, toward the front of the pump fluid end 22 (and the pump 10) is along the x-axis toward front S1, and toward the back of the pump fluid end 22 (and the pump 10) is along the x-axis away from front S1.

Figure 2B:
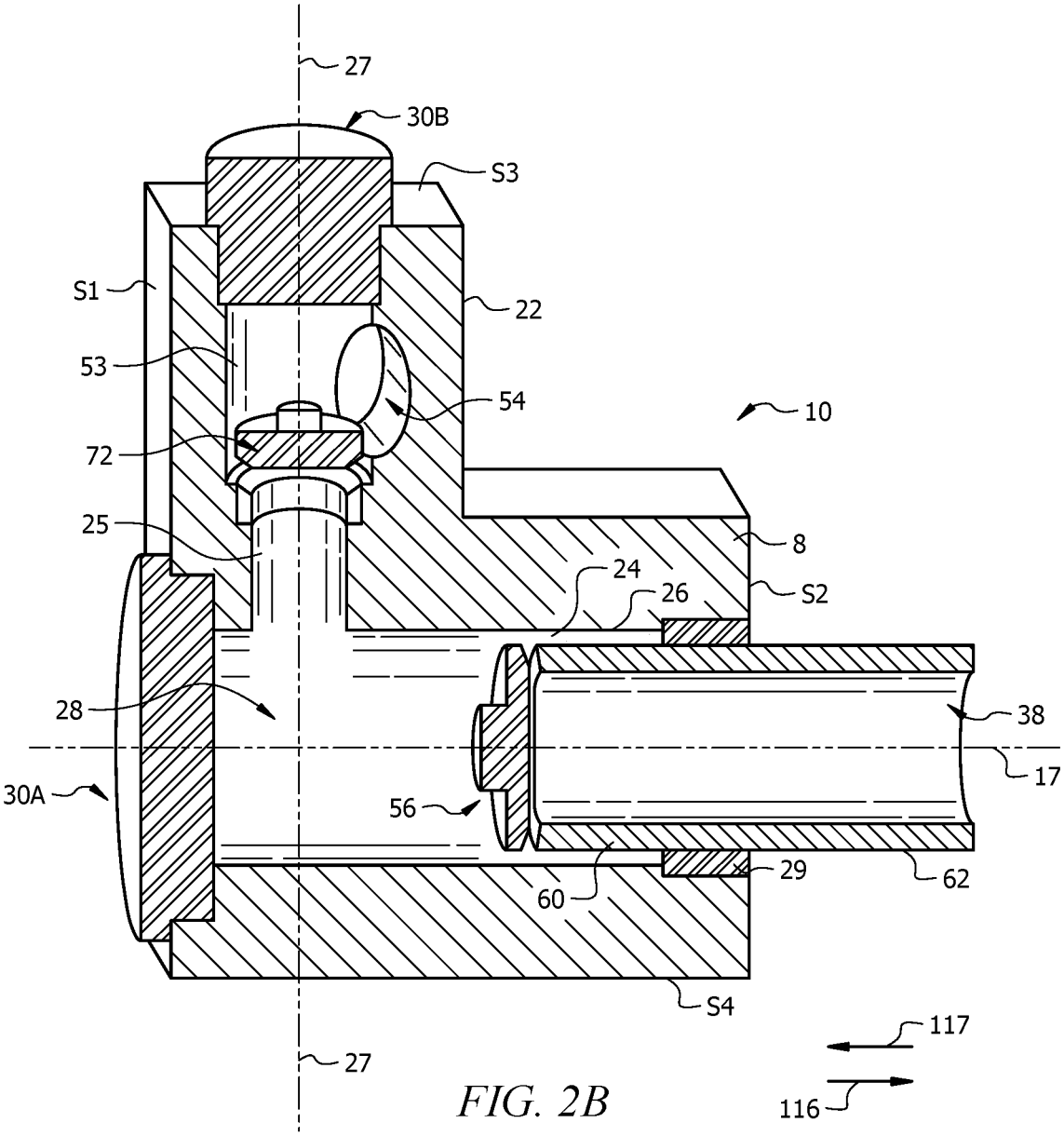
FIG. 2B is a cut-away view illustrating an exemplary pump comprising a cross-bore (referred to as a "tee-bore" or "T-bore" herein) pump fluid end according to an embodiment of the disclosure.

The pump fluid end 22 is integrated with the pump power end 12 via the integration section 11, such that the pump power end 12 is operable to reciprocate the reciprocating element 18 within a reciprocating element bore 24 (see FIGS. 2A and 2B) of the pump fluid end 22. The reciprocating element bore 24 is at least partially defined by a cylinder wall 26. As described further hereinbelow with reference to FIG. 2A, pump fluid end 22 of this disclosure can be an in-line or "concentric" bore pump fluid end. In alternative embodiments, described further hereinbelow with reference to FIG. 2B, pump fluid end 22 is a "cross-bore" pump fluid end 22, which, as utilized herein, can include "T-bore" pump fluid ends, "X-bore" (e.g., cross shaped bore) pump fluid ends, or "Y-bore" pump fluid ends. FIG. 2A is a schematic showing a concentric bore pump fluid end 22 engaged with a reciprocating element 18. FIG. 2B is a schematic showing a T-bore pump fluid end 22 engaged with a reciprocating element 18. As discussed further below, the pump 10 includes at least one fluid inlet 38 for receiving fluid from a fluid source, e.g., a suction line, suction header, storage or mix tank, blender, discharge from a boost pump such as a centrifugal pump, etc. The pump 10 also includes at least one discharge outlet 54 for discharging fluid to a discharge source, e.g., a flowmeter, pressure monitoring and control system, distribution header, discharge line, wellhead, discharge manifold pipe, and the like.

The pump 10 may comprise any suitable pump power end 12 for enabling the pump 10 to perform pumping operations (e.g., pumping a wellbore servicing fluid downhole). Similarly, the pump 10 may include any suitable housing 14 for containing and/or supporting the pump power end 12 and components thereof. The housing 14 may comprise various combinations of inlets, outlets, channels, and the like for circulating and/or transferring fluid. Additionally, the housing 14 may include connections to other components and/or systems, such as, but not limited to, pipes, tanks, drive mechanisms, etc. Furthermore, the housing 14 may be configured with cover plates or entryways for permitting access to the pump power end 12 and/or other pump components. As such, the pump 10 may be inspected to determine whether parts need to be repaired or replaced. The pump power end may also be hydraulically driven, whether it is a non-intensifying or an intensifying system.

Figure 3:
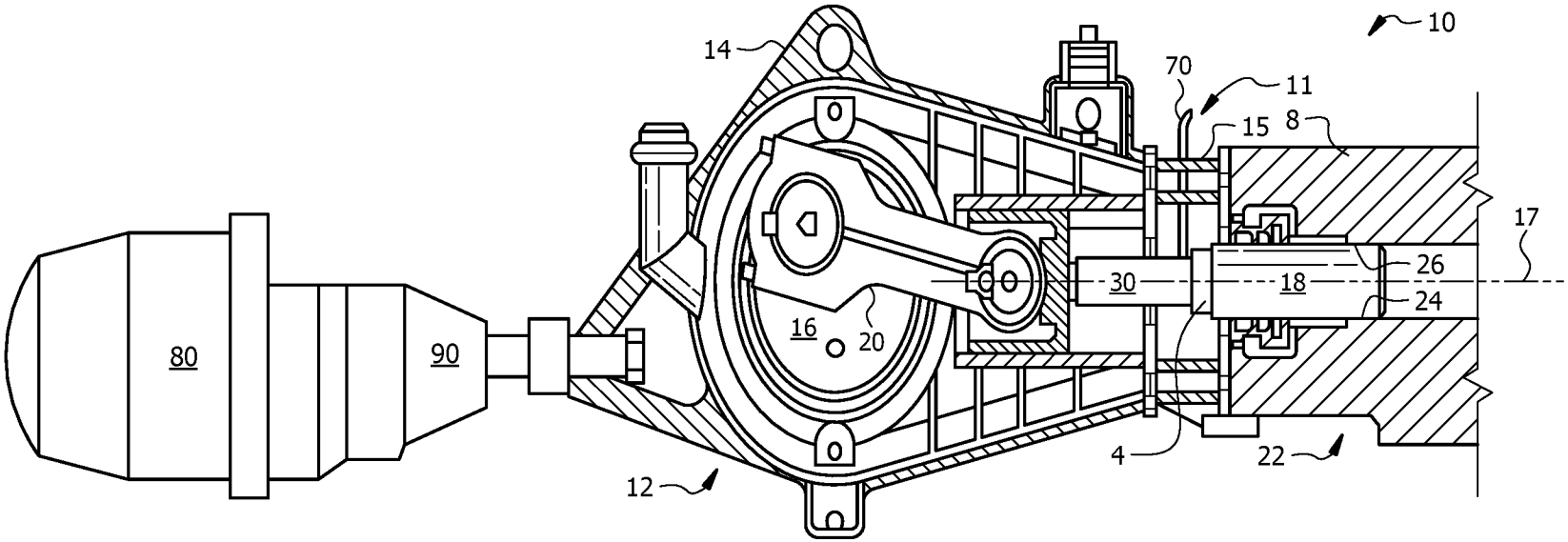
FIG. 3 is a cut-away view illustrating a pump power end of a pump according to an embodiment of the disclosure.

Those versed in the art will understand that the pump power end 12 may include various components commonly employed in pumps. For example, pump power end 12 comprises a power source 80 (sometimes referred to as a prime mover), a transmission 90, and a crankshaft assembly disposed within housing 14 (e.g., a crankcase). Pump power end 12 can be any suitable pump known in the art and with the help of this disclosure to be operable to reciprocate reciprocating element 18 in reciprocating element bore 24. For example, without limitation, pump power end 12 can be operable via and comprise a crank and slider mechanism, a powered hydraulic/pneumatic/steam cylinder mechanism or various electric, mechanical or electro-mechanical drives. FIG. 3 provides a cutaway illustration of an exemplary pump 10 of this disclosure, showing an exemplary pump power end 12, integrated via integration section 11 with a pump fluid end 22, wherein the pump power end 12 is operable to reciprocate the reciprocating element 18 within a reciprocating element bore 24 of the pump fluid end 22. Briefly, for example, the pump power end 12 may include a rotatable crankshaft 16 attached to at least one reciprocating element 18 (e.g., a plunger or piston) by way of a crank arm 20 and pushrod 30. Additionally, an engine (e.g., a diesel engine), motor, or other suitable power source may be operatively connected to the crankshaft 16 (e.g., through a transmission and drive shaft) and operable to actuate rotation thereof. In operation, rotation of the crankshaft 16 induces translational movement of the crank arm rod 20, thereby causing the reciprocating element 18 to extend and retract along a flow path, which may generally be defined by a central axis 17 within a reciprocating element bore 24 (sometimes referred to herein for brevity as a "reciprocating element bore 24" or simply a "bore 24", although not wishing to be limited to a particular reciprocating element 18). Pump 10 of FIG. 1 is typically mounted on a movable structure such as a semi-tractor trailer or skid, and the moveable structure may contain additional components, such as a motor or engine (e.g., a diesel engine), that provides power (e.g., mechanical motion) to the pump power end 12 (e.g., a crankcase comprising crankshaft 16 and related connecting rods 20). In embodiments, the power source 80 is mechanically coupled to the crankshaft 16 by a transmission 90.

Of course, numerous other components associated with the pump power end 12 of the pump 10 may be similarly employed, and therefore, fall within the purview of the present disclosure. Furthermore, since the construction and operation of components associated with pumps of the sort depicted in FIG. 1 are well known and understood, discussion of the pump 10 will herein be limited to the extent necessary for enabling a proper understanding of the disclosed embodiments.

As noted hereinabove, the pump 10 comprises a pump fluid end 22 attached to the pump power end 12. Various embodiments of the pump fluid end 22 are described in detail below in connection with other drawings, for example FIG. 2A and FIG. 2B. Generally, the pump fluid end 22 comprises at least one fluid inlet 38 for receiving fluid, and at least one discharge outlet 54 through which fluid flows out of the discharge chamber 53. The pump fluid end 22 also comprises at least one valve assembly for controlling the receipt and output of fluid. For example, the pump fluid end 22 can comprise a suction valve assembly 56 and a discharge valve assembly 72. The pump fluid end 22 may include any suitable component(s) and/or structure(s) for containing and/or supporting the reciprocating element 18 and providing a cylinder wall 26 at least partially defining a reciprocating element bore 24 along which the pump power end can reciprocate the reciprocating element during operation of the pump.

In embodiments, the pump fluid end 22 may comprise a cylinder wall 26 at least partially defining a bore 24 through which the reciprocating element 18 may extend and retract. Additionally, the bore 24 may be in fluid communication with a discharge chamber 53 formed within the pump fluid end 22. Such a discharge chamber 53, for example, may be configured as a pressurized discharge chamber 53 having a discharge outlet 54 through which fluid is discharged by the reciprocating element 18. Thus, the reciprocating element 18 may be movably disposed within the reciprocating element bore 24, which may provide a fluid flow path into and/or out of the pump chamber. During operation of the pump 10, the reciprocating element 18 may be configured to reciprocate along a path (e.g., along central axis 17 within bore 24 and/or pump chamber 28, which corresponds to reciprocal movement parallel to the x-axis of FIG. 1) to transfer a supply of fluid to the pump chamber 28 and/or discharge fluid from the pump chamber 28.

In operation, the reciprocating element 18 extends and retracts along a flow path to alternate between providing forward strokes (also referred to as discharge strokes and correlating to movement in a positive direction parallel to the x-axis of FIG. 1) and return strokes (also referred to as suction strokes and correlating to movement in a negative direction parallel to the x-axis of FIG. 1), respectively. During a forward stroke, the reciprocating element 18 extends away from the pump power end 12 and toward the pump fluid end 22. Before the forward stoke begins, the reciprocating element 18 is in a fully retracted position (also referred to as bottom dead center (BDC) with reference to the crankshaft 16), in which case the suction valve assembly 56 can be in a closed configuration having allowed fluid to flow into the (e.g., high pressure) pump chamber 28. When discharge valve assembly 72 is in a closed configuration (e.g., under the influence of a closing mechanism, such as a spring, the high pressure in a discharge pipe or manifold containing discharge outlet 54) prevents fluid flow into discharge chamber 53 and causes pressure in the pump chamber 28 to accumulate upon stroking of the reciprocating element 18. When the reciprocating element 18 begins the forward stroke, the pressure builds inside the pump chamber 28 and acts as an opening force that results in positioning of the discharge valve assembly 72 in an open configuration, while a closing force (e.g., via a closing mechanism, such as a spring and/or pressure increase inside pump chamber 28) urges the suction valve assembly 56 into a closed configuration. When utilized in connection with a valve assembly, 'open' and 'closed' refer, respectively, to a configuration in which fluid can flow through the valve assembly (e.g., can pass between a valve body and a valve seat thereof) and a configuration in which fluid cannot flow through the valve assembly (e.g., cannot pass between a valve body and a valve seat thereof). As the reciprocating element 18 extends forward, fluid within the pump chamber 28 is discharged through the discharge outlet 54.

During a return stroke, the reciprocating element 18 reciprocates or retracts away from the pump fluid end 22 and towards the pump power end 12 of the pump 10. Before the return stroke begins, the reciprocating element 18 is in a fully extended position (also referred to as top dead center (TDC) with reference to the crankshaft 16), in which case the discharge valve assembly 72 can be in a closed configuration having allowed fluid to flow out of the pump chamber 28 and the suction valve assembly 56 is in a closed configuration. When the reciprocating element 18 begins and retracts towards the pump power end 12, the discharge valve assembly 72 assumes a closed configuration, while the suction valve assembly 56 opens. As the reciprocating element 18 moves away from the discharge valve 72 during a return stroke, fluid flows through the suction valve assembly 56 and into the pump chamber 28.

With reference to the embodiment of FIG. 2A, which is a schematic showing a concentric pump fluid end 22 engaged with a reciprocating element 18, concentric bore pump fluid end 22 comprises a concentric bore fluid end body 8, a concentric pump chamber 28, a suction valve assembly 56, and a discharge valve assembly 72. In this concentric bore configuration of FIG. 2A, suction valve assembly 56 and discharge valve assembly 72 are positioned in-line (also referred to as coaxial) with reciprocating element bore 24, i.e., central axis 17 of reciprocating element bore 24 is also the central axis of suction pump assembly 56 and discharge valve assembly 72). With reference to the embodiment of FIG. 2B, which is a schematic showing a T-bore pump fluid end 22 engaged with a reciprocating element 18, T-bore pump fluid end 22 comprises a T-bore fluid end body 8, a T-shaped pump chamber 28, a suction valve assembly 56, and a discharge valve assembly 72. In this T-bore configuration of FIG. 2B, suction valve assembly 56 is coupled with front end 60 of reciprocating element 18 and discharge valve assembly 72 is positioned in bore 25 that makes a tee with reciprocating element bore 24, i.e., central axis 17 of reciprocating element bore 24 is also the central axis of suction pump assembly 56 and perpendicular to a central axis 27 of discharge valve assembly 72).

Suction valve assembly 56 and discharge valve assembly 72 are operable to direct fluid flow within the pump 10. In pump fluid end 22 designs of this disclosure, fluid flows within a hollow reciprocating element (e.g., a hollow plunger) 18 via fluid inlet 38 located toward tail end 62 of reciprocating element 18. The reciprocating element bore 24 of such a fluid end design can be defined by a high-pressure cylinder 26 providing a high-pressure chamber. (As utilized here, "high pressure" indicates possible subjection to high pressure during discharge.) When reciprocating element 18 retracts, or moves along central axis 17 in a direction away from the pump chamber 28 and pump fluid end 22 and toward pump power end 12 (as indicated by arrow 116), a suction valve of the suction valve assembly 56 opens (e.g., either under natural flow and/or other biasing means), and a discharge valve of discharge valve assembly 72 will be closed, whereby fluid enters pump chamber 28 via a fluid inlet 38. For a pump fluid end 22 design of this disclosure, the fluid inlet 38 is configured to introduce fluid into pump chamber 28 via a reciprocating element 18 that is hollow. When the reciprocating element 18 reverses direction, due to the action of the pump power end 12, the reciprocating element 18 reverses direction along central axis 17, now moving in a direction toward the pump chamber 28 and pump fluid end 22 and away from pump power end 12 (as indicated by arrow 117), and the discharge valve of discharge valve assembly 72 is open and the suction valve of suction valve assembly 56 is closed (e.g., again either due to fluid flow and/or other biasing means of valve control), such that fluid is pumped out of pump chamber 28 via discharge chamber 53 and discharge outlet 54.

A pump 10 of this disclosure can comprise one or more access ports. With reference to the concentric fluid end body 8 embodiment of FIG. 2A, a front access port 30A can be located on a front S1 of the pump fluid end 22 opposite a back S2 of the pump fluid end 22, wherein the back S2 of the pump fluid end is proximal the pump power end 12, upon integration therewith via integration section 11. With reference to the T-bore fluid end body 8 embodiment of FIG. 2B, a front access port 30A can be located on a front S1 of the pump fluid end 22 opposite a back S2 of the pump fluid end 22, wherein the back S2 of the pump fluid end is proximal the pump power end 12, upon integration therewith via integration section 11, and a top access port 30B can be located on a top S3 of the pump fluid end 22 opposite a bottom S4 of pump fluid end 22. Locations described as front S1, back S2, top S3, and bottom S4 are further described with reference to the x-y-z coordinate system shown in FIG. 1 and further can be relative to a surface (e.g., a trailer bed, the ground, a platform, etc.) upon which the pump 10 is located, a bottom S4 of the pump fluid end being proximal the surface (e.g., trailer bed) upon which the pump 10 is located. Generally, due to size and positioning of pump 10, the front S1 and top S3 of the pump fluid end 22 are more easily accessible than a back S2 or bottom S4 thereof. In a similar manner, a front of pump 10 is distal the pump power end 12 and a back of the pump 10 is distal the pump fluid end 22. The integration section 11 can be positioned in a space between the pump fluid end 22 and the pump power end 12, and can be safeguarded (e.g., from personnel) via a cover 15.

In embodiments, a pump fluid end 22 and pump 10 of this disclosure comprise at least one access port. In embodiments, the at least one access port is located on a side of the discharge valve assembly 72 opposite the suction valve assembly 56. For example, in the concentric bore pump fluid end 22 embodiment of FIG. 2A, front access port 30A is located on a side (e.g., front side) of discharge valve assembly 72 opposite suction valve assembly 56. In the T-bore pump fluid end 22 embodiment of FIG. 2B, front access port 30A is located on top S3 of pump fluid end 22.

In embodiments, one or more seals 29 (e.g., "O-ring" seals, packing seals, or the like), also referred to herein as "primary" reciprocating element packing 29 may be arranged around the reciprocating element 18 to provide sealing between the outer walls of the reciprocating element 18 and the inner walls 26 defining at least a portion of the reciprocating element bore 24. In fluid end designs such as described herein operated with a hollow reciprocating element 18, a second set of seals (also referred to herein as "secondary" reciprocating element packing; not shown in the Figures) is conventionally arranged around the reciprocating element 18 to provide sealing between the outer walls of the reciprocating element 18 and the inner walls of a low-pressure cylinder that defines a low pressure fluid chamber (e.g., wherein the secondary packing is farther back along the x-axis and delineates a back end of a low pressure chamber that extends from the primary packing 29 to the secondary packing). According to this disclosure, only a primary reciprocating element packing is utilized, as fluid enters tail end 62 of reciprocating element 18 without first contacting an outer peripheral wall thereof (i.e., no secondary reciprocating element packing is needed/utilized, because no low-pressure chamber external to reciprocating element 18 is utilized). Skilled artisans will recognize that the seals of the primary packing may comprise any suitable type of seals, and the selection of seals may depend on various factors e.g., fluid, temperature, pressure, etc.

While the foregoing discussion focused on a pump fluid end 22 comprising a single reciprocating element 18 disposed in a single reciprocating element bore 24, it is to be understood that the pump fluid end 22 may include any suitable number of reciprocating elements. As discussed further below, for example, the pump 10 may comprise a plurality of reciprocating elements 18 and associated reciprocating element bores 24 arranged in parallel and spaced apart along the z-axis of FIG. 1 (or another arrangement such as a V block or radial arrangement). In such a multi-bore pump, each reciprocating element bore may be associated with a respective reciprocating element and crank arm, and a single common crankshaft may drive each of the plurality of reciprocating elements and crank arms. Alternatively, a multi-bore pump may include multiple crankshafts, such that each crankshaft may drive a corresponding reciprocating element. Furthermore, the pump 10 may be implemented as any suitable type of multi-bore pump. In a non-limiting example, the pump 10 may comprise a Triplex pump having three reciprocating elements 18 (e.g., plungers or pistons) and associated reciprocating element bores 24, discharge valve assemblies 72 and suction valve assemblies 56, or a Quintuplex pump having five reciprocating elements 18 and five associated reciprocating element bores 24, discharge valve assemblies 72 and suction valve assemblies 56.

Reciprocating element bore 24 can have an inner diameter slightly greater than the outer diameter of the reciprocating element 18, such that the reciprocating element 18 may sufficiently reciprocate within reciprocating element bore 24. In embodiments, the fluid end body 8 of pump fluid end 22 has a pressure rating ranging from about 100 psi to about 3000 psi, or from about 2000 psi to about 10,000 psi, from about 5000 psi to about 30,000 psi, or from about 3000 psi to about 50,000 psi or greater. The fluid end body 8 of pump fluid end 22 may be cast, forged or formed from any suitable materials, e.g., steel, metal alloys, or the like. Those versed in the art will recognize that the type and condition of material(s) suitable for the fluid end body 8 may be selected based on various factors. In a wellbore servicing operation, for example, the selection of a material may depend on flow rates, pressure rates, wellbore service fluid types (e.g., particulate type and/or concentration present in particle laden fluids such as fracturing fluids or drilling fluids, or fluids comprising cryogenic/foams), etc. Moreover, the fluid end body 8 (e.g., cylinder wall 26 defining at least a portion of reciprocating element bore 24 and/or pump chamber 28) may include protective coatings for preventing and/or resisting abrasion, erosion, and/or corrosion.

In embodiments, the cylindrical shape (e.g., providing cylindrical wall(s) 26) of the fluid end body 8 may be pre-stressed in an initial compression. Moreover, a high-pressure cylinder(s) providing the cylindrical shape (e.g., providing cylindrical wall(s) 26) may comprise one or more sleeves (e.g., heat-shrinkable sleeves). Additionally or alternatively, the high-pressure cylinder(s) may comprise one or more composite overwraps and/or concentric sleeves ("over-sleeves"), such that an outer wrap/sleeve pre-loads an inner wrap/sleeve. The overwraps and/or over-sleeves may be non-metallic (e.g., fiber windings) and/or constructed from relatively lightweight materials. Overwraps and/or over-sleeves may be added to increase fatigue strength and overall reinforcement of the components.

The cylinders and cylindrical-shaped components (e.g., providing cylindrical wall 26) associated with the pump fluid end body 8 of pump fluid end 22 may be held in place within the pump 10 using any appropriate technique. For example, components may be assembled and connected, e.g., bolted, welded, etc. Additionally or alternatively, cylinders may be press-fit into openings machined or cast into the pump fluid end 22 or other suitable portion of the pump 10. Such openings may be configured to accept and rigidly hold cylinders (e.g., having cylinder wall(s) 26 at least partially defining reciprocating element bore 24) in place so as to facilitate interaction of the reciprocating element 18 and other components associated with the pump 10.

In embodiments, the reciprocating element 18 comprises a plunger or a piston. While the reciprocating element 18 may be described herein with respect to embodiments comprising a plunger, it is to be understood that the reciprocating element 18 may comprise any suitable component for displacing fluid. In a non-limiting example, the reciprocating element 18 may be a piston. As those versed in the art will readily appreciate, a piston-type pump generally employs sealing elements (e.g., rings, packing, etc.) attached to the piston and movable therewith. In contrast, a plunger-type pump generally employs fixed or static seals (e.g., primary seal or packing 29) through which the plunger moves during each stroke (e.g., suction stroke or discharge stroke).

As skilled artisans will understand, the reciprocating element 18 may include any suitable size and/or shape for extending and retracting along a flow path within the pump fluid end 22. For instance, reciprocating element 18 may comprise a generally cylindrical shape, and may be sized such that the reciprocating element 18 can sufficiently slide against or otherwise interact with the inner cylinder wall 26. In embodiments, one or more additional components or mechanical linkages may be used to couple the reciprocating element 18 to the pump power end 12 (e.g., to a crank arm 20 or pushrod 30).

According to this disclosure, reciprocating element 18 employed in a concentric bore pump fluid end 22 embodiment (such as depicted in FIG. 2A) or a T-bore pump fluid end 22 (such as depicted in FIG. 2B) comprises a peripheral wall 84 defining a hollow body. In embodiments, a portion of the peripheral wall 84 may be generally permeable or may include an input through which fluid may enter the hollow body and an output through which fluid may exit the hollow body. Furthermore, while the reciprocating element 18 may, in embodiments, define a substantially hollow interior and include a ported body, a base of the reciprocating element 18 proximal the pump power end, when assembled, may be substantially solid and/or impermeable (e.g., a plunger having both a hollow portion and a solid portion).

The reciprocating element 18 comprises a front or free end 60. In embodiments, the reciprocating element 18 can contain or at least partially contain the suction valve assembly 56. In one aspect, the suction valve assembly 56 is at least partially disposed within the reciprocating element 18 at or proximate to the front end 60 thereof. At an opposite or tail end 62 (also referred to as back or tail end 62) of the reciprocating element 18, the reciprocating element 18 may include a base coupled to the pump power end 12 of the pump 10 (e.g., via crank arm 20). In embodiments, the tail end 62 of the reciprocating element 18 is coupled to the pump power end 12 outside of pump fluid end 22, e.g., within integration section 11.

As noted above, pump fluid end 22 contains a suction valve assembly 56. Suction valve assembly 56 may alternately open or close to permit or prevent fluid flow. Skilled artisans will understand that the suction valve assembly 56 may be of any suitable type or configuration (e.g., gravity- or spring-biased, flow activated, etc.). Those versed in the art will understand that the suction valve assembly 56 may be disposed within the pump fluid end 22 at any suitable location therein. For instance, the suction valve assembly 56 may be disposed within reciprocating element bore 24 and at least partially within reciprocating element 18 in concentric bore pump fluid end 22 designs such as FIG. 2A or T-bore pump fluid end 22 designs such as FIG. 2B, such that a suction valve body of the suction valve assembly 56 moves away from a suction valve seat within the a suction valve seat housing of reciprocating element 18 when the suction valve assembly 56 is in an open configuration and toward the suction valve seat when the suction valve assembly 56 is in a closed configuration.

Pump 10 comprises a discharge valve assembly 72 for controlling the output of fluid through discharge chamber 53 and discharge outlet 54. Analogous to the suction valve assembly 56, the discharge valve assembly 72 may alternately open or close to permit or prevent fluid flow. Those versed in the art will understand that the discharge valve assembly 72 may be disposed within the pump chamber at any suitable location therein. For instance, the discharge valve assembly 72 may be disposed proximal the front S1 of bore 24 (e.g., at least partially within discharge chamber 53 and/or pump chamber 28) of the pump fluid end 22, such that a discharge valve body of the discharge valve assembly 72 moves toward the discharge chamber 53 when the discharge valve assembly 72 is in an open configuration and away from the discharge chamber 53 when the discharge valve assembly 72 is in a closed configuration. In addition, in concentric bore pump fluid end 22 configurations such as FIG. 2A, the discharge valve assembly 72 may be coaxially aligned with the suction valve assembly 56 (e.g., along central axis 17), and the suction valve assembly 56 and the discharge valve assembly 72 may be coaxially aligned with the reciprocating element 18 (e.g., along central axis 17). In alternative embodiments, such as the T-bore pump fluid end 22 embodiment of FIG. 2B, discharge valve assembly 72 can be positioned within T-bore 25, at least partially within discharge chamber 53 and/or pump chamber 28, and have a central axis coincident (e.g., coaxial) with central axis 27 of T-bore 25.

Further, the suction valve assembly 56 and the discharge valve assembly 72 can comprise any suitable mechanism for opening and closing valves. For example, the suction valve assembly 56 and the discharge valve assembly 72 can comprise a suction valve spring and a discharge valve spring, respectively. Additionally, any suitable structure (e.g., valve assembly comprising sealing rings, stems, poppets, etc.) and/or components may be employed suitable means for retaining the components of the suction valve assembly 56 and the components of the discharge valve assembly 72 within the pump fluid end 22 may be employed.

The pump 10 may comprise and/or be coupled (as detailed further hereinbelow) to any suitable fluid source for supplying fluid to the pump via the fluid inlet 38. In embodiments, the pump 10 may also comprise and/or be coupled to a pressure source such as a boost pump (e.g., a suction boost pump) fluidly connected to the pump 10 (e.g., via inlet 38) and operable to increase or "boost" the pressure of fluid introduced to pump 10 via fluid inlet 38. A boost pump may comprise any suitable type including, but not limited to, a centrifugal pump, a gear pump, a screw pump, a roller pump, a scroll pump, a piston/plunger pump, or any combination thereof. For instance, the pump 10 may comprise and/or be coupled to a boost pump known to operate efficiently in high-volume operations and/or may allow the pumping rate therefrom to be adjusted. Skilled artisans will readily appreciate that the amount of added pressure may depend and/or vary based on factors such as operating conditions, application requirements, etc. In one aspect, the boost pump may have an outlet pressure greater than or equal to about 70 psi, about 80 psi, or about 110 psi, providing fluid to the suction side of pump 10 at about said pressures. Additionally or alternatively, the boost pump may have a flow rate of greater than or equal to about 80 BPM, about 70 BPM, and/or about 50 BPM.

As noted hereinabove, the pump 10 may be implemented as a multi-cylinder pump comprising multiple cylindrical reciprocating element bores 24 and corresponding components. In embodiments, the pump 10 is a Triplex pump in which the pump fluid end 22 comprises three reciprocating assemblies, each reciprocating assembly comprising a suction valve assembly 56, a discharge valve assembly 72, a pump chamber 28, a fluid inlet 38, a discharge outlet 54, and a reciprocating element bore 24 within which a corresponding reciprocating element 18 reciprocates during operation of the pump 10 via connection therewith to a (e.g., common) pump power end 12. In embodiments, the pump 10 is a Quintuplex pump in which the pump fluid end 22 comprises five reciprocating assemblies. In a non-limiting example, the pump 10 may be a Q-10™ Quintuplex Pump or an HT-400™ Triplex Pump, produced by Halliburton Energy Services, Inc.

In embodiments, the pump fluid end 22 may comprise an external or stationary fluid manifold (e.g., a suction header), as described in more detail hereinbelow for feeding fluid to the multiple reciprocating assemblies via any suitable inlet (s). Additionally or alternatively, the pump fluid end 22 may comprise separate conduits such as hoses fluidly connected to separate inlets for inputting fluid to each reciprocating assembly. Of course, numerous other variations may be similarly employed, and therefore, fall within the scope of the present disclosure.

Those skilled in the art will understand that the reciprocating elements of each of the reciprocating assemblies may be operatively connected to the pump power end 12 of the pump 10 according to any suitable manner. For instance, separate connectors (e.g., cranks arms 20, connecting rods, etc.) associated with the pump power end 12 may be coupled to each reciprocating element body or tail end 62. The pump 10 may employ a common crankshaft (e.g., crankshaft 16) or separate crankshafts to drive the multiple reciprocating elements.

As previously discussed, the multiple reciprocating elements may receive a supply of fluid from any suitable fluid source, which may be configured to provide a constant fluid supply. Additionally or alternatively, the pressure of supplied fluid may be increased by adding pressure (e.g., boost pressure) as described previously. In embodiments, the fluid inlet(s) 38 receive a supply of pressurized fluid comprising a pressure ranging from about 30 psi to about 300 psi.

Additionally or alternatively, the one or more discharge outlet(s) 54 may be fluidly connected to a common collection point such as a sump or distribution manifold, which may be configured to collect fluids flowing out of the fluid outlet(s) 54, or another cylinder bank and/or one or more additional pumps.

During pumping, the multiple reciprocating elements 18 will perform forward and returns strokes similarly, as described hereinabove. In embodiments, the multiple reciprocating elements 18 can be angularly offset to ensure that no two reciprocating elements are located at the same position along their respective stroke paths (i.e., the plungers are "out of phase"). For example, the reciprocating elements may be angularly distributed to have a certain offset (e.g., 120 degrees of separation in a Triplex pump) to minimize undesirable effects that may result from multiple reciprocating elements of a single pump simultaneously producing pressure pulses. The position of a reciprocating element is generally based on the number of degrees a pump crankshaft (e.g., crankshaft 16) has rotated from a bottom dead center (BDC) position. The BDC position corresponds to the position of a fully retracted reciprocating element at zero velocity, e.g., just prior to a reciprocating element moving (i.e., in a direction indicated by arrow 117 in FIG. 2A and FIG. 2B) forward in its cylinder. A top dead center position corresponds to the position of a fully extended reciprocating element at zero velocity, e.g., just prior to a reciprocating element moving backward (i.e., in a direction indicated by arrow 116 in FIG. 2A and FIG. 2B) in its cylinder.

As described above, each reciprocating element 18 is operable to draw in fluid during a suction (backward or return) stroke and discharge fluid during a discharge (forward) stroke. Skilled artisans will understand that the multiple reciprocating elements 18 may be angularly offset or phase-shifted to improve fluid intake for each reciprocating element 18. For instance, a phase degree offset (at 360 degrees divided by the number of reciprocating elements) may be employed to ensure the multiple reciprocating elements 18 receive fluid and/or a certain quantity of fluid at all times of operation. In one implementation, the three reciprocating elements 18 of a Triplex pump may be phase-shifted by a 120-degree offset. Accordingly, when one reciprocating element 18 is at its maximum forward stroke position, a second reciprocating element 18 will be 60 degrees through its discharge stroke from BDC, and a third reciprocating element will be 120 degrees through its suction stroke from top dead center (TDC).

With reference back to FIG. 3, according to this disclosure, and as described further hereinbelow, a pump 10 comprises: a pump fluid end 22 (e.g., a concentric bore pump fluid end 22 such as depicted in FIG. 2A or a cross-bore pump fluid end such as T-bore pump fluid end 22 of FIG. 2B) and a power end 12, operatively connected via an integration section 11. A pump 10 of this disclosure comprises an integration section 11, integrated between pump fluid end 22 and pump power end 12, as described further hereinbelow.

As described above, the pump power end 12 is coupled to a pump fluid end 22 having a reciprocating element bore 24, within which a reciprocatable reciprocating element 18 reciprocates due to the action of the power end 12, which is operatively connected to the reciprocating element 18 and operable to reciprocate the reciprocating element 18 in the reciprocating element bore 24 of the pump fluid end 22. The reciprocating element 18 has a front end 60 opposite a fluid intake or tail end 62 and comprises a peripheral wall 84 defining a hollow cylindrical body. In embodiments, fluid can be supplied to the flow through plunger by way of a fluid inlet conduit or manifold. In other embodiments, fluid can be supplied to the reciprocating element 18 by way of a fluid inlet conduit or manifold.

Figure 4:
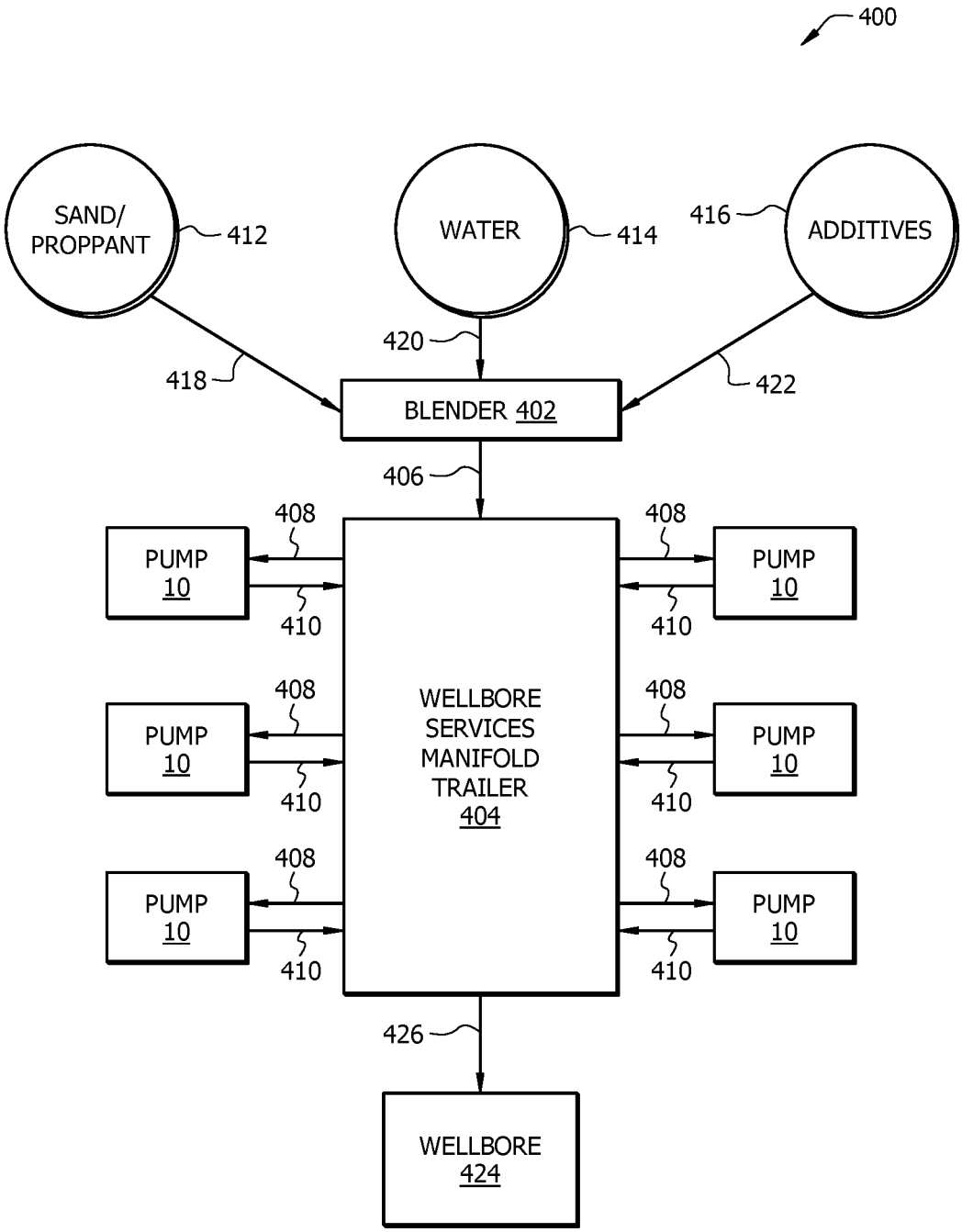
FIG. 4 is a block diagram illustrating a wellbore and wellbore servicing system according to an embodiment of the disclosure.

Turning now to FIG. 4, a method of servicing a wellbore and a wellbore servicing system 400 comprising a pump of this disclosure (e.g., the pump 10) is described. FIG. 4 is a schematic representation of an embodiment of a wellbore servicing system 400, according to embodiments of this disclosure.

A method of servicing a wellbore 424 according to this disclosure comprises fluidly coupling the pump 10 of this disclosure to a source of a wellbore servicing fluid and to the wellbore, and communicating wellbore servicing fluid into the wellbore via the pump. The method can further comprise discontinuing the communicating of the wellbore servicing fluid into the wellbore via the pump, subjecting the pump to maintenance to provide a maintained pump, and communicating the or another wellbore servicing fluid into the wellbore via the maintained pump. Subjecting the pump to maintenance can comprise servicing the pump 10, as described hereinabove.

In embodiments, a method of servicing a wellbore 424 comprises: fluidly coupling a pump 10 to a source of a wellbore servicing fluid and to the wellbore 424; and communicating wellbore servicing fluid into the wellbore 424 via the pump 10, wherein the pump 10 comprises a pump fluid end 22 and a pump power end 12; wherein the pump power end 22 is operable to reciprocate a reciprocating element 18 within the reciprocating element bore 24 of the pump fluid end 22, wherein the pump fluid end 22 comprises: the reciprocating element 18 disposed at least partially within the reciprocating element bore 24 of the pump fluid end 22; a discharge valve assembly 72; and a suction valve assembly 56.

Embodiments of the wellbore servicing system 400 disclosed herein are usable for any purpose. In embodiments, the wellbore servicing system 400 may be used to service a wellbore 424 that penetrates a subterranean formation by pumping a wellbore servicing fluid into the wellbore and/or subterranean formation. As used herein, a "wellbore servicing fluid" or "servicing fluid" refers to a fluid used to drill, complete, work over, fracture, repair, or in any way prepare a wellbore for the recovery of materials residing in a subterranean formation penetrated by the wellbore. It is to be understood that "subterranean formation" encompasses both areas below exposed earth and areas below earth covered by water such as ocean or fresh water. Examples of servicing fluids suitable for use as the wellbore servicing fluid, another wellbore servicing fluid, or both include, but are not limited to, cementitious fluids (e.g., cement slurries), drilling fluids or muds, spacer fluids, fracturing fluids or completion fluids, and gravel pack fluids, remedial fluids, perforating fluids, sealants, drilling fluids, completion fluids, diverter fluids, gelation fluids, polymeric fluids, aqueous fluids, oleaginous fluids, and any other fluid used in wellbore servicing.

In embodiments, the wellbore servicing system 400 comprises one or more pumps 10 operable to perform oilfield or well servicing operations. Such operations may include, but are not limited to, drilling operations, fracturing operations, perforating operations, fluid loss operations, primary cementing operations, secondary or remedial cementing operations, or any combination of operations thereof. Although a wellbore servicing system 400 is illustrated, skilled artisans will readily appreciate that the pump 10 disclosed herein may be employed in any suitable operation.

In embodiments, the wellbore servicing system 400 may be a system such as a fracturing spread for fracturing wells in a hydrocarbon-containing reservoir. In fracturing operations, wellbore servicing fluids, such as particle laden fluids, are pumped at high-pressure into a wellbore. The particle-laden fluids may then be introduced into a portion of a subterranean formation at a sufficient pressure and velocity to cut a casing or create perforation tunnels and fractures within the subterranean formation. Proppants, such as grains of sand, are mixed with the wellbore servicing fluid to keep the fractures open so that hydrocarbons may be produced from the subterranean formation and flow into the wellbore. Hydraulic fracturing may desirably create high-conductivity fluid communication between the wellbore and the subterranean formation.

The wellbore servicing system 400 comprises a blender 402 that is coupled to a wellbore services manifold trailer 404 via flowline 406. As used herein, the term "wellbore services manifold trailer" includes a truck or trailer comprising one or more manifolds for receiving, organizing, or distributing wellbore servicing fluids during wellbore servicing operations. In this embodiment, the wellbore services manifold trailer 404 is coupled to six positive displacement pumps (e.g., such as pump 10 that may be mounted to a trailer and transported to the wellsite via a semi-tractor) via outlet flowlines 408 and inlet flowlines 410. In alternative embodiments, however, there may be more or less pumps used in a wellbore servicing operation. Outlet flowlines 408 are outlet lines from the wellbore services manifold trailer 404 that supply fluid to the pumps 10. Inlet flowlines 410 are inlet lines from the pumps 10 that supply fluid to the wellbore services manifold trailer 404.

The blender 402 mixes solid and fluid components to achieve a well-blended wellbore servicing fluid. As depicted, sand or proppant 412, water 414, and additives 416 are fed into the blender 402 via feedlines 418, 420, and 412, respectively. The water 414 may be potable, non-potable, untreated, partially treated, or treated water. In embodiments, the water 414 may be produced water that has been extracted from the wellbore while producing hydrocarbons form the wellbore. The produced water may comprise dissolved and/or entrained organic materials, salts, minerals, paraffins, aromatics, resins, asphaltenes, and/or other natural or synthetic constituents that are displaced from a hydrocarbon formation during the production of the hydrocarbons. In embodiments, the water 414 may be flowback water that has previously been introduced into the wellbore during wellbore servicing operation. The flowback water may comprise some hydrocarbons, gelling agents, friction reducers, surfactants, or remnants of wellbore servicing fluids previously introduced into the wellbore during wellbore servicing operations.

The water 414 may further comprise local surface water contained in natural or manmade water features (such as ditches, ponds, rivers, lakes, oceans, etc.). Still further, the water 414 may comprise water stored in local or remote containers. The water 414 may be water that originated from near the wellbore or may be water that has been transported to an area near the wellbore from any distance. In some embodiments, the water 414 may comprise any combination of produced water, flowback water, local surface water, or container stored water. In some implementations, water may be substituted by nitrogen or carbon dioxide; some in a foaming condition.

In embodiments, the blender 402 may be an Advanced Dry Polymer (ADP) blender and the additives 416 are dry blended and dry fed into the blender 402. In alternative embodiments, however, additives may be pre-blended with water using other suitable blenders, such as, but not limited to, a GEL PRO blender, which is a commercially available preblender trailer from Halliburton Energy Services, Inc., to form a liquid gel concentrate that may be fed into the blender 402. The mixing conditions of the blender 402, including time period, agitation method, pressure, and temperature of the blender 402, may be chosen by one of ordinary skill in the art with the aid of this disclosure to produce a homogeneous blend having a desirable composition, density, and viscosity. In alternative embodiments, however, sand or proppant, water, and additives may be premixed or stored in a storage tank before entering a wellbore services manifold trailer 404.

In embodiments, the pump(s) 10 (e.g., pump(s) 10 or maintained pump(s) 10) pressurize the wellbore servicing fluid to a pressure suitable for delivery into a wellbore 424 or wellhead. For example, the pumps 10 may increase the pressure of the wellbore servicing fluid (e.g., the wellbore servicing fluid or the another wellbore servicing fluid) to a pressure of greater than or equal to about 10,000 psi, 20,000 psi, 30,000 psi, 40,000 psi, or 50,000 psi, or higher.

From the pumps 10, the wellbore servicing fluid may reenter the wellbore services manifold trailer 404 via inlet flowlines 410 and be combined so that the wellbore servicing fluid may have a total fluid flow rate that exits from the wellbore services manifold trailer 404 through flowline 426 to the wellhead 424 of between about 1 BPM to about 200 BPM, alternatively from between about 50 BPM to about 150 BPM, alternatively about 100 BPM. In embodiments, each of one or more pumps 10 discharge wellbore servicing fluid at a fluid flow rate of between about 1 BPM to about 200 BPM, alternatively from between about 50 BPM to about 150 BPM, alternatively about 100 BPM. Persons of ordinary skill in the art with the aid of this disclosure will appreciate that the flowlines described herein are piping that are connected together for example via flanges, collars, welds, etc. These flowlines may include various configurations of pipe tees, elbows, and the like. These flowlines connect together the various wellbore servicing fluid process equipment described herein.

Also disclosed herein are methods for servicing a wellbore (e.g., wellbore 424). Without limitation, servicing the wellbore may include: positioning the wellbore servicing composition in the wellbore 424 (e.g., via one or more pumps 10 as described herein) to isolate the subterranean formation from a portion of the wellbore; to support a conduit in the wellbore; to plug a void or crack in the conduit; to plug a void or crack in a cement sheath disposed in an annulus of the wellbore; to plug a perforation; to plug an opening between the cement sheath and the conduit; to prevent the loss of aqueous or nonaqueous drilling fluids into loss circulation zones such as a void, vugular zone, or fracture; to plug a well for abandonment purposes; to divert treatment fluids; and/or to seal an annulus between the wellbore and an expandable pipe or pipe string. In other embodiments, the wellbore servicing systems and methods may be employed in well completion operations such as primary and secondary cementing operation to isolate the subterranean formation from a different portion of the wellbore.

In embodiments, a wellbore servicing method may comprise transporting a positive displacement pump (e.g., pump 10) to a site for performing a servicing operation. Additionally, or alternatively, one or more pumps may be situated on a suitable structural support. Non-limiting examples of a suitable structural support or supports include a trailer, truck, skid, barge or combinations thereof. In embodiments, a motor or other power source for a pump may be situated on a common structural support.

In embodiments, a wellbore servicing method may comprise providing a source for a wellbore servicing fluid. As described above, the wellbore servicing fluid may comprise any suitable fluid or combinations of fluid as may be appropriate based upon the servicing operation being performed. Non-limiting examples of suitable wellbore servicing fluid include a fracturing fluid (e.g., a particle-laden fluid, as described herein), a perforating fluid, a cementitious fluid, a sealant, a remedial fluid, a drilling fluid (e.g., mud), a spacer fluid, a gravel pack fluid, a diverter fluid, a gelation fluid, a polymeric fluid, an aqueous fluid, an oleaginous fluid, an emulsion, various other wellbore servicing fluid as will be appreciated by one of skill in the art with the aid of this disclosure, and combinations thereof. The wellbore servicing fluid may be prepared on-site (e.g., via the operation of one or more blenders) or, alternatively, transported to the site of the servicing operation.

In embodiments, a wellbore servicing method may comprise fluidly coupling a pump 10 to the wellbore servicing fluid source. As such, wellbore servicing fluid may be drawn into and emitted from the pump 10. Additionally, or alternatively, a portion of a wellbore servicing fluid placed in a wellbore 424 may be recycled, i.e., mixed with the water stream obtained from a water source and treated in fluid treatment system. Furthermore, a wellbore servicing method may comprise conveying the wellbore servicing fluid from its source to the wellbore via the operation of the pump 10 disclosed herein.

In alternative embodiments, the reciprocating apparatus may comprise a compressor. In embodiments, a compressor similar to the pump 10 may comprise at least one each of a cylinder, plunger, connecting rod, crankshaft, and housing, and may be coupled to a motor or the power source 80 of FIG. 1 and FIG. 3. In embodiments, such a compressor may be similar in form to a pump and may be configured to compress a compressible fluid (e.g., a gas) and thereby increase the pressure of the compressible fluid. For example, a compressor may be configured to direct the discharge therefrom to a chamber or vessel that collects the compressible fluid from the discharge of the compressor until a predetermined pressure is built up in the chamber. Generally, a pressure sensing device may be arranged and configured to monitor the pressure as it builds up in the chamber and to interact with the compressor when a predetermined pressure is reached. At that point, the compressor may either be shut off, or alternatively the discharge may be directed to another chamber for continued operation.

In embodiments, a reciprocating apparatus (e.g., power source 80) comprises an internal combustion engine, hereinafter referred to as an engine. Such engines are also well known, and typically include at least one each of a plunger, cylinder, connecting rod, and crankshaft. The arrangement of these components is substantially the same in an engine and a pump (e.g. pump 10). A reciprocating element 18 such as a plunger may be similarly arranged to move in reciprocating fashion within the cylinder. Skilled artisans will appreciate that operation of an engine may somewhat differ from that of a pump. In a pump, rotational power is generally applied to a crankshaft acting on the plunger via the connecting rod, whereas in an engine, rotational power generally results from a force (e.g., an internal combustion) exerted on or against the plunger, which acts against the crankshaft via the connecting rod.

For example, in a typical four-stroke engine, arbitrarily beginning with the exhaust stroke, the plunger is fully extended during the exhaust stroke (that is, minimizing the internal volume of the cylinder). The plunger may then be retracted by inertia or other forces of the engine componentry during the intake stroke. As the plunger retracts within the cylinder, the internal volume of cylinder increases, creating a low pressure within the cylinder into which an air-fuel mixture is drawn. When the plunger is fully retracted within the cylinder, the intake stroke is complete, and the cylinder is substantially filled with the air/fuel mixture. As the crankshaft continues to rotate, the plunger may then be extended, during the compression stroke, into the cylinder compressing the air-fuel mixture within the cylinder to a higher pressure.

A spark plug may be provided to ignite the fuel at a predetermined point in the compression stroke. This ignition increases the temperature and pressure within the cylinder substantially and rapidly. In a diesel engine, however, the spark plug may be omitted, as the heat of compression derived from the high compression ratios associated with diesel engines suffices to provide spontaneous combustion of the air-fuel mixture. In either case, the heat and pressure act forcibly against the plunger and cause it to retract back into the cylinder during the power cycle at a substantial force, which may then be exerted on the connecting rod, and thereby on to the crankshaft.

Figure 5:
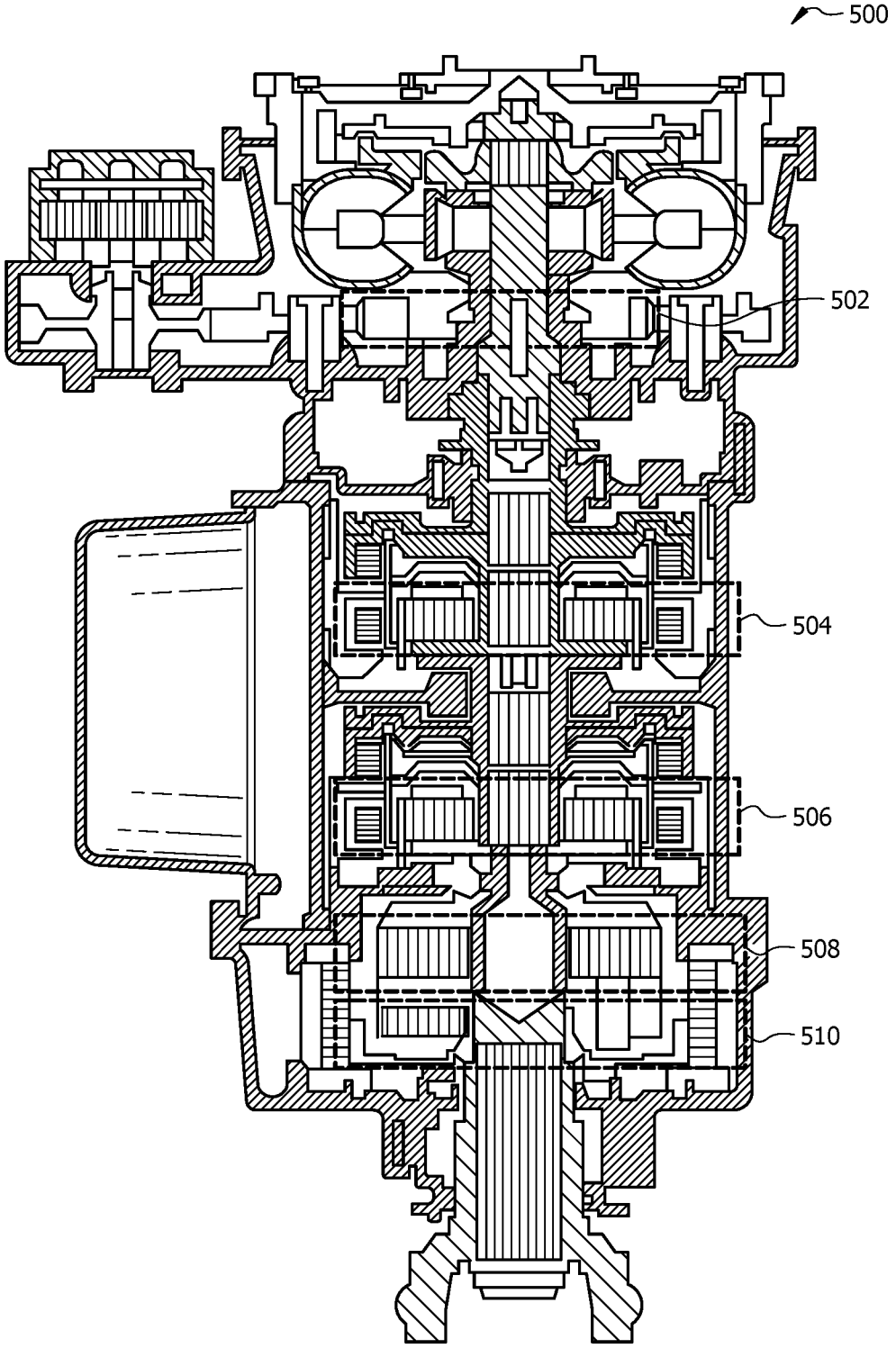
FIG. 5 is a cross sectional view illustrating a transmission usable with a hydraulic fracturing pump according to an embodiment of the disclosure.

Turning now to FIG. 5, a cross sectional view illustrating a transmission 500 usable with a hydraulic fracturing pump according to an embodiment of the disclosure is described. The transmission 500 comprises at least one carrier 502 communicatively coupled to four planetary gears: a first planetary gear 504, a second planetary gear 506, a third planetary gear 508, and a fourth planetary gear 510. In some alternative embodiments, there are fewer or more than four planetary gears; except as indicated otherwise herein, the systems and methods disclosed herein are configurable to account for the number of planetary gears present in the transmission.

In some embodiments, each of the first planetary gear 504, the second planetary gear 506, the third planetary gear 508, and the fourth planetary gear 510 comprise an epicyclic gear train. In general, a planetary gear or a group of planetary gears work within the transmission at least to vary the speed of the transmission. In embodiments, the speed of the transmission is sometimes referred to by a gear number (e.g., first gear, second gear, third gear, etc.), corresponding to various engagement combinations of the first planetary gear 504, the second planetary gear 506, the third planetary gear 508, and the fourth planetary gear 510.

In embodiments of the transmission 500, the transmission 500 is communicatively coupled with at least one sensor configured to measure various time domain features and frequency domain features as described elsewhere herein. In embodiments, the at least one sensor includes at least one accelerometer. The at least one accelerometer records high quality spectra data at a fixed time interval.

In embodiments, the measured time domain and frequency domain features, in particular spectra recorded by the accelerometers, are used as inputs to engineer features for use in transmission failure prediction by an ML model as discussed in more detail elsewhere herein. These engineered features are used in combination with measured features for transmission failure prediction.

Figure 6:
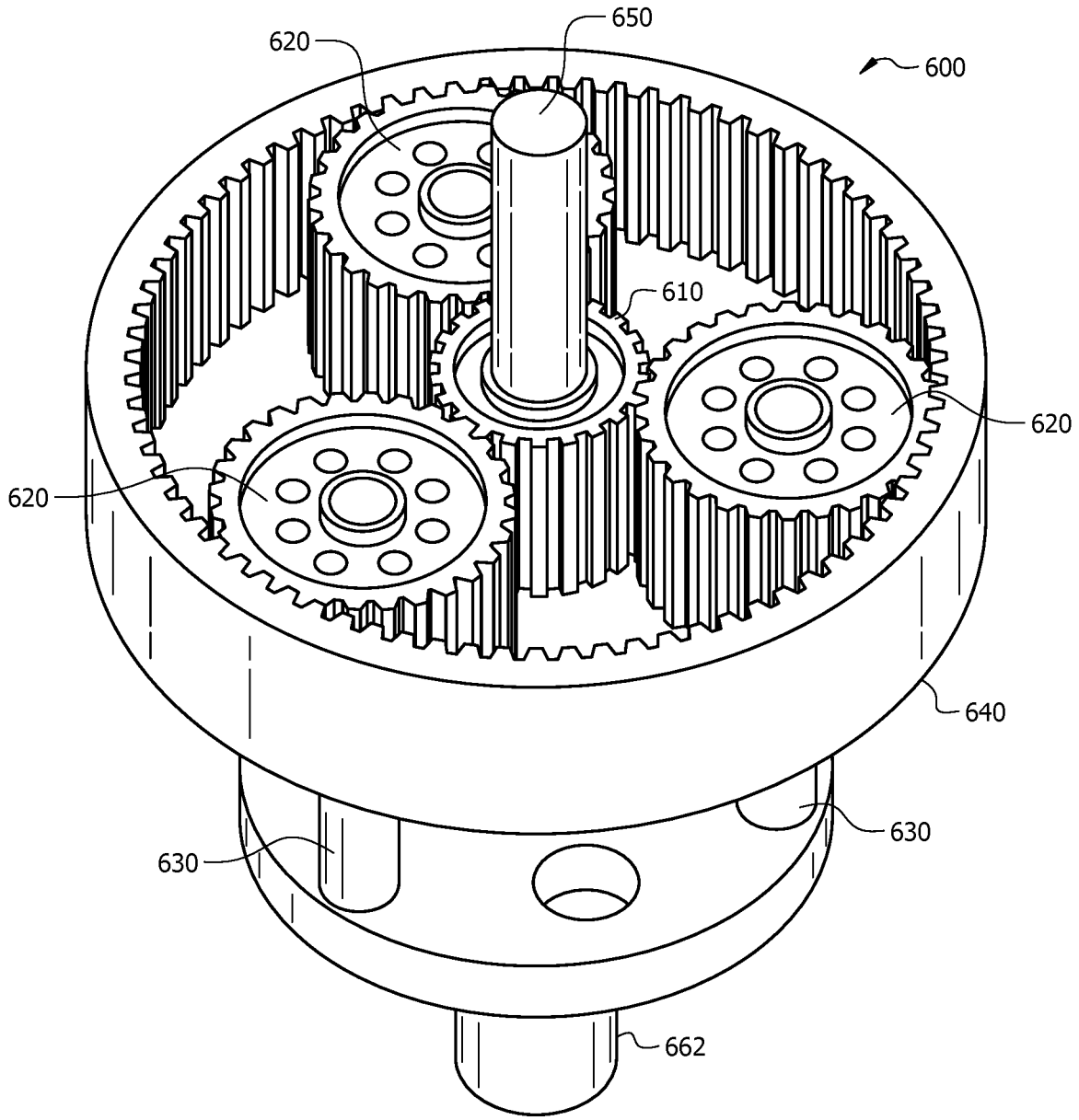
FIG. 6 is a perspective view illustrating a planetary gear of a transmission according to an embodiment of the disclosure.

Turning now to FIG. 6, a perspective view illustrating a planetary gear system 600 of a transmission according to an embodiment of the disclosure is described. In some embodiments, at least one of the first planetary gear 504, the second planetary gear 506, the third planetary gear 508, and the fourth planetary gear 510 are implementations of the planetary gear system 600. In some embodiments, the planetary gear system 600 is included in a planetary gearbox assembly. The planetary gear system 600 includes a sun gear 610, a collection of planet gears 620 on a planet gear carrier 630, and a ring gear 640. The planet gear carrier 630 is rotationally coupled to and is driven by an input shaft 662. In some embodiments, the input shaft 662 is mechanically coupled to or integrated within the carrier 502 of the transmission 500. The sun gear 610 is rotationally coupled to and drives an output shaft 650. In operation, when the planet gear carrier 630 is rotated by the input shaft 662 and the ring gear 630 is held stationary, the planet gears 620 will revolve around the sun gear 610. The revolution of the planet gears 620 rotates the sun gear 610 and the output shaft 650 at a rotational speed that is higher than that of the input shaft 662 and the planet gear carrier 630. In the example of the planetary gearbox assembly 660, the ring gear 640 is formed about the interior of a housing, which is held substantially stationary. When the input shaft 662 is rotated, the planetary gear system 600 increases rotational speed at the output shaft 650. In some embodiments, multiple stages of planetary gear systems 600 are usable for higher speed reduction.

The rotation of the output shaft 650 drives the rotation of an output assembly. In some implementations, the output assembly is a fluid pump as disclosed herein. For example, rotation of a drive shaft of the output assembly at a first speed, e.g., about 120 RPM, can be transferred through magnetic couplers, a spur gear, and the planetary gearbox assembly to spin a fluid pump at a second, generally higher speed, e.g., 5000 RPM. The fluid pump provides pressurized fluids for use by, e.g., downhole fluid actuators. In some embodiments, these are hydraulic actuators. The speeds discussed above are for exemplary purposes only and intended to be non-limiting.

In some embodiments, the output assembly is an electrical generator. For example, rotation of the drive shaft at the first speed is be transferred through the magnetic couplers, the spur gear, and the planetary gearbox assembly to spin a generator at a second, generally higher speed to produce electrical energy that can be used to drive downhole electronics and electrical components.

In some embodiments, the planetary gearbox assembly is configured to reduce the speed of the input shaft 662 and provide the reduced rotational speed through the output shaft 650. For example, in some embodiments, the planetary gear system 600 accepts rotational energy at the output shaft 650 to drive the sun gear 610 while the ring gear 640 is held substantially stationary.

Rotation of the sun gear 610 drives the revolution of the planet gears 620 about the sun gear 610, which in turn drives the rotation of the planet gear carrier 630. Rotation of the planet gear carrier 630 at an input speed drives the rotation of the output shaft 650 at a speed that is reduced compared to the input speed. In such implementations, a rotational speed can be reduced. For example, the planetary gearbox assembly can be configured for speed reduction, and can be used as a speed reducer to manipulate downhole tool faces and offset magnitudes.

In another embodiment, the planetary gearbox assembly can used to increase the amount of torque being provided from a rotational input. For example, the planetary gearbox assembly is indirectly coupled to a drive shaft through the magnetic couplers. In some example magnetic couplers, the amount of torque that can be transferred can be limited due to the non-contacting nature of magnetic couplers. Implementations of the planetary gearbox assembly as a speed reducer can help by amplifying the torque provided through the magnetic coupler to a rotational load. In some embodiments, multiple stages can be used for higher speed reduction.

Figure 7:
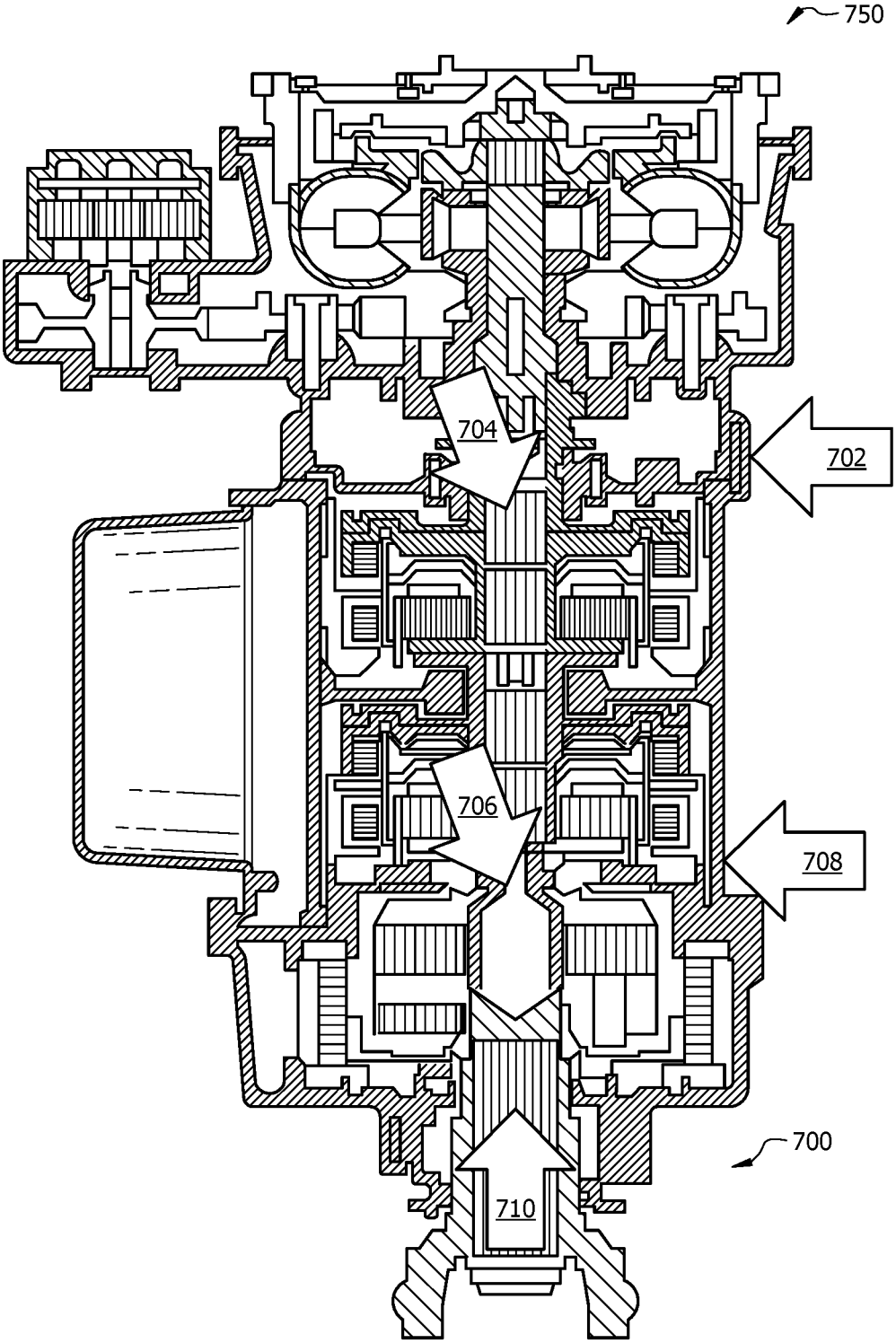
FIG. 7 is a cross sectional view illustrating a plurality of accelerometers of a transmission according to an embodiment of the disclosure.

Turning now to FIG. 7, a cross sectional view illustrating a plurality of accelerometers 700 of a transmission 750 according to an embodiment of the disclosure is described. In some embodiments, the transmission 750 is the transmission 500 of FIG. 5, and the plurality of accelerometers 700 are the at least one sensor referenced in the discussion of the transmission 500 herein. In some embodiments, the plurality of accelerometers 700 include five accelerometers configured to take spectral recordings: a first accelerometer 702, a second accelerometer 704, a third accelerometer 706, a fourth accelerometer 708, and a fifth accelerometer 710. Some other embodiments include more or less accelerometers as appropriate to the characteristics of the transmission 750. In some embodiments, the first accelerometer 702 and the second accelerometer 704 record spectra in a horizontal direction. In some embodiments, the third accelerometer 706 and the fourth accelerometer 708 record spectra in the vertical direction. In some embodiments, the fifth accelerometer 710 records spectra in the axial direction of the transmission 750. In some of the foregoing embodiments, the first accelerometer 702, the second accelerometer 704, the third accelerometer 706, the fourth accelerometer 708, and the fifth accelerometer 710 record spectra for about one second. This recorded spectra is converted into frequency domain data for further analysis as described elsewhere herein.

Figure 8:
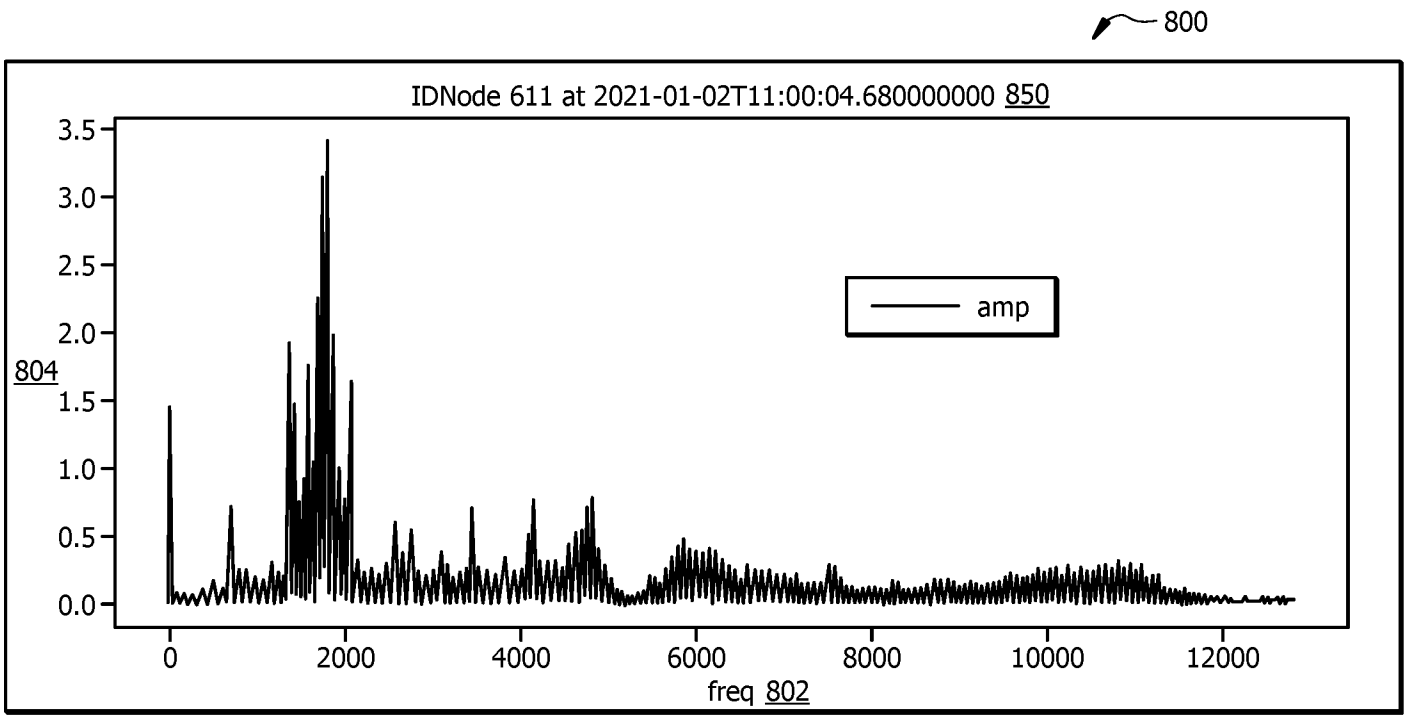
FIG. 8 is a plot view illustrating a spectra recording according to an embodiment of the disclosure.

Turning now to FIG. 8, a plot view illustrating a spectra recording 800 according to an embodiment is disclosed. The spectra recording 800 comprises a set of datapoints indicating a frequency 802 having an associated amplitude 804. The spectra recording 800 is captured at a time indicated by a timestamp 850. The spectra recording 800 is an example of a spectral recording as described in the discussion of the plurality of accelerometers 700 of FIG. 7 as discussed elsewhere herein. While the spectra recording 800 of only a single accelerometer is discussed herein, this discussion is applicable to, e.g., all the accelerometers of the plurality of accelerometers 700.

In embodiments, the spectra recording 800 comprises at least eight-thousand datapoints. Attempting to use an ML model to make a transmission failure prediction using so many datapoints involves an avoidable level of computational expense and complexity. Instead, when used to predict the failure of a transmission of a pump as described elsewhere herein, the spectra recording 800 is used as an input to engineer statistically at least ten features usable as input to an ML model. These engineered features are: mean, median, variance, standard deviation, kurtosis (a measure of the tailedness of a probability distribution of a real-valued random variable), skewness (a measure of the asymmetry of the probability distribution of a real-valued random variable about the mean of the random variable), a root mean square (RMS) value, a crest factor (placing emphasis on peaks), a frequency center, and an RMS frequency.

Figure 9:
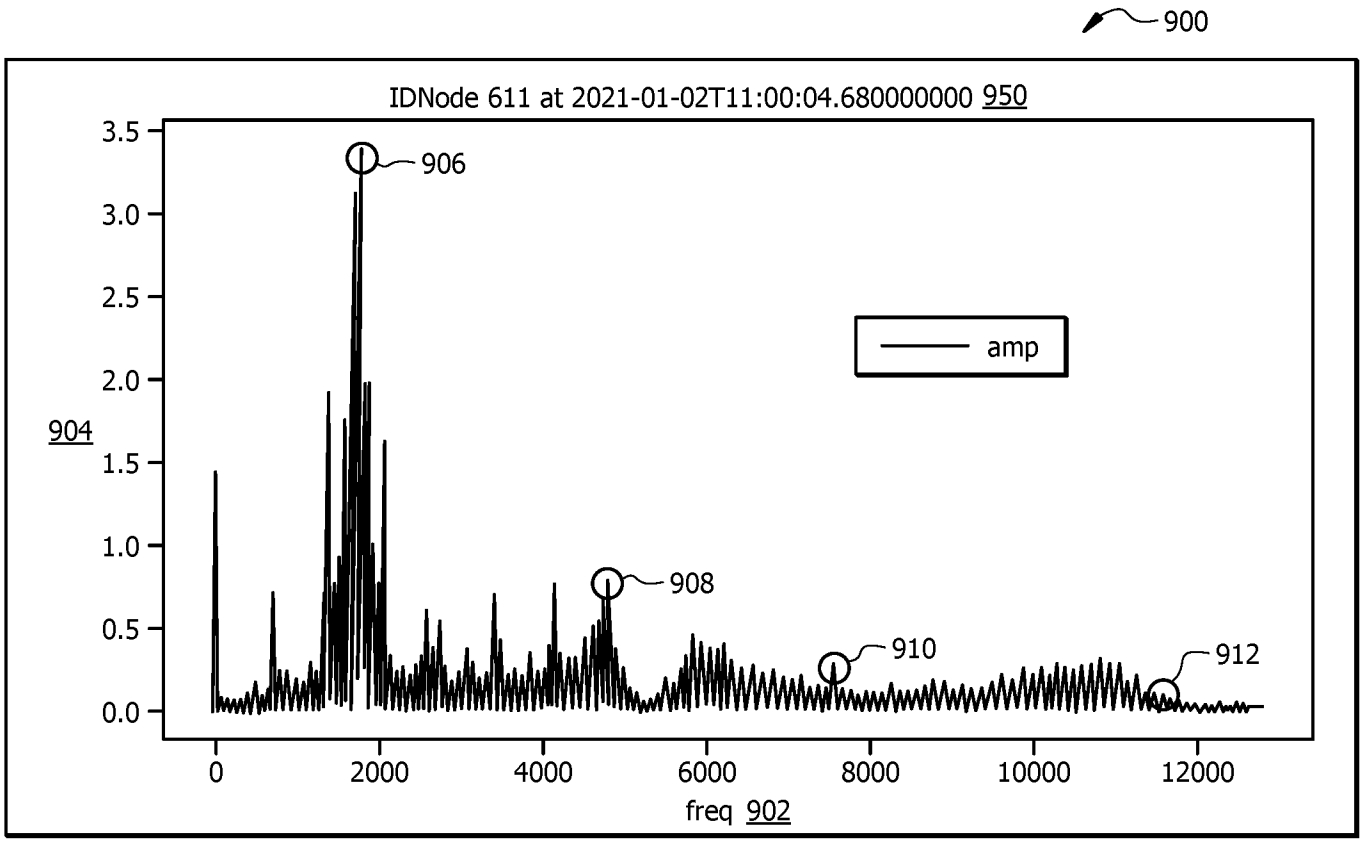
FIG. 9 is a plot view illustrating additional non-statistical features extracted as per characteristic frequencies generated by various meshing planetary gears according to an embodiment of the disclosure.

Turning now to FIG. 9, a plot view illustrating additional non-statistical features 900 extracted as per characteristic frequencies generated by various meshing planetary gears according to an embodiment of the disclosure. In some embodiments, the additional statistical features 900 comprise a set of datapoints indicating a frequency 902 having an associated amplitude 904. The additional non-statistical features 900 are extracted at a time indicated by a timestamp 950. A first CF 906, a second CF 908, a third CF 910, and a fourth CF 912 are indicated by labeled circles. Each of the first CF 906, the second CF 908, the third CF 910, and the fourth CF 912 have a frequency value as indicated by the x-axis, and that frequency value has an associated amplitude value as indicated by the y-axis. In combination, each x- and y-axis pair (or rather, each of the first CF 906, the second CF 908, the third CF 910, and the fourth CF 912 are used as additional non-statistical features in an ML model configured to predict failure of a transmission of a pump as described elsewhere herein.

Figure 10:
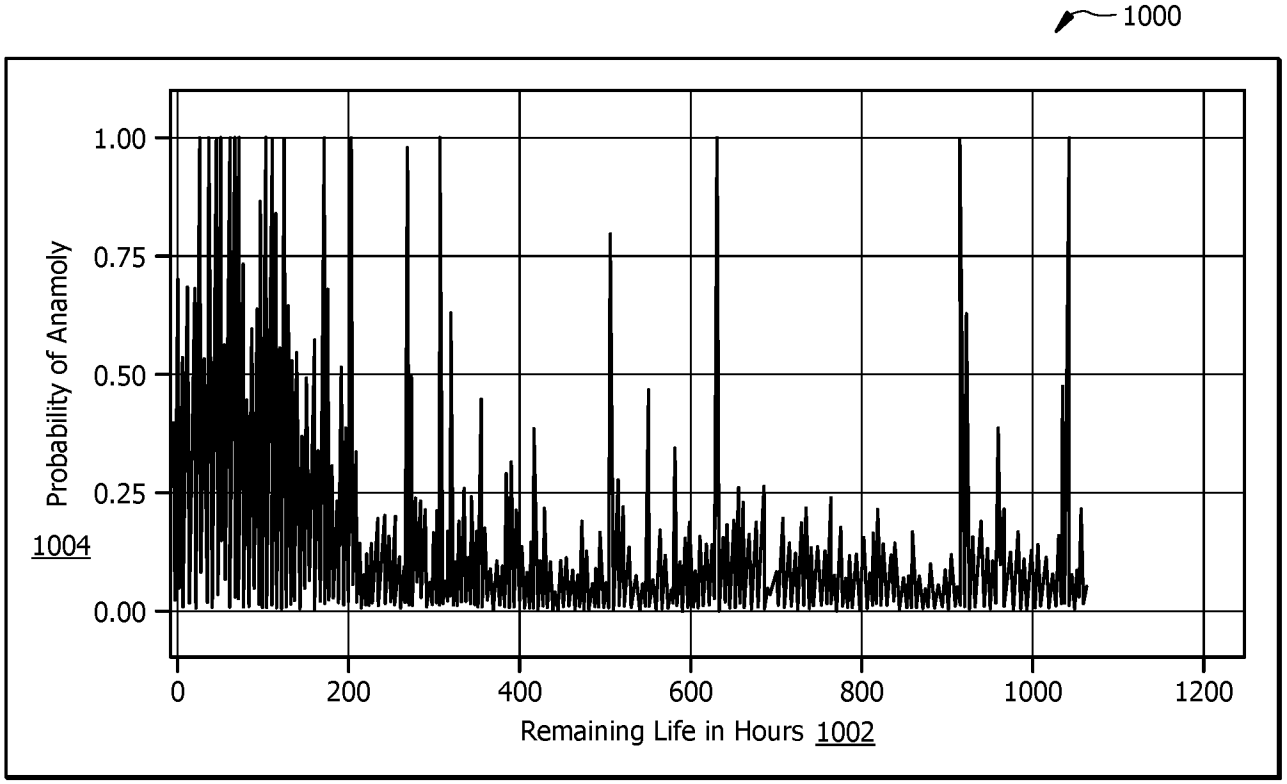
FIG. 10 is a plot view illustrating an anomaly detection model analysis output according to an embodiment of the disclosure.

Turning now to FIG. 10, a plot view illustrating an anomaly detection model analysis output 1000 according to an embodiment of this disclosure is described. Embodiments of transmission failure prediction as described throughout this disclosure utilize an anomaly detection model as the ML model. The anomaly detection model analysis output 1000 as shown plots a predicted remaining life of a transmission 1002 (in hours) along the x-axis, and a probability of anomaly 1004 along the y-axis.

In embodiments herein, the anomaly detection model analysis output 1000 is the resultant output of using the anomaly detection model to predict the failure of a transmission of a pump. Feature input to the anomaly detection model includes but is not limited to the features previously discussed and shown in prior figures herein: a combination of statistical features, CF features, and time-domain features. The extreme left of the plot, for example, shows that high probabilities indicating anomalous behavior of the transmission are dense on the plot towards the failure point of transmission.

As discussed elsewhere herein, the anomaly detection model analysis output 1000 is subjected to post-processing to generate a failure alert associated with the transmission under analysis. The failure alert indicates a prediction that the transmission is going to fail within a certain amount of time. In some embodiments, a determination to generate the failure alert is made by choosing (1) an optimized threshold of anomaly probability (0 to 1) indicating the probability of the presence of at least one failure indicator in the feature input, and (2) a number of times this threshold was crossed.

In embodiments of the disclosure which generate a production impact score as discussed elsewhere herein, after the failure alert is generated as discussed above and elsewhere herein, the production impact score is generated and evaluated. In embodiments where the production impact score is in the form of the cost saved metric, a set of factors is used to evaluate the cost-saved metric including but not limited to: a predicted failure point in time, an actual failure point in time based on historical data drawn from similar transmissions under similar conditions which experienced catastrophic failure, a mean running life of the transmission under analysis, a known cost of a catastrophic transmission failure repair job; a known cost of a general (non-catastrophic) repair or remediation procedure, and a desired time to issue the failure alert before the catastrophic failure is predicted to occur.

In embodiments herein, the disclosed systems and methods enable remediating a predicted catastrophic failure into, at worst, a general (non-catastrophic) failure using a remediation procedure. But, if the failure alert is issued too early before the transmission under analysis would actually fail, then production time at the well is lost, and any cost savings is undercut by unnecessarily lost profits. By contrast, in some such embodiments, a remediation procedure takes at least twelve hours after a failure alert. If the transmission under analysis fails in less than twelve hours after the failure alert is triggered, there are no cost savings.

Figure 11:
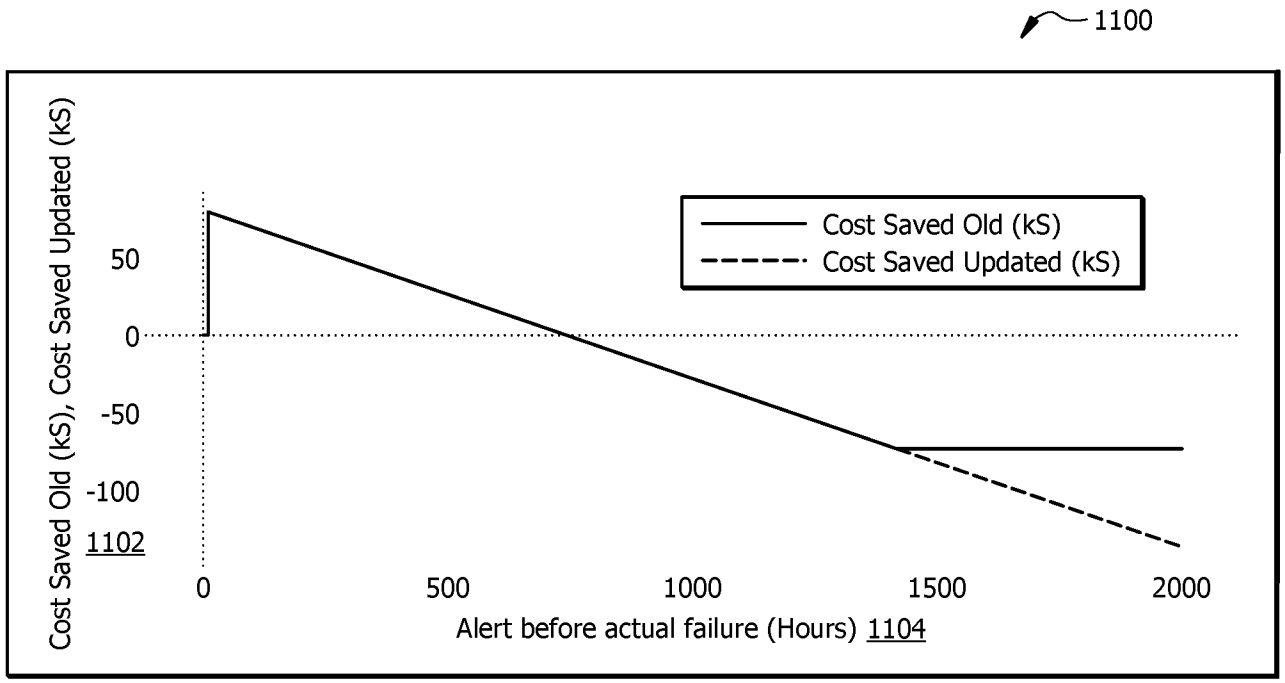
FIG. 11 is a plot view illustrating a cost-saved metric compared to alarm trigger times according to an embodiment of the disclosure.

Turning now to FIG. 11, a plot view illustrating a cost-saved metric compared to alarm trigger times 1100 (or, a cost-saved metric plot 1100) according to an embodiment of the disclosure is described. The cost-saved metric plot 1100 is readily described using a non-limiting example, based on analysis of historical data and known United States dollar values for various types of repairs and remediation procedures. In other embodiments, these costs are different without impacting how the analysis is done.

The y-axis plots a projected cost savings 1102 against alert hours before failure 1104. The alert hours before failure 1104 is a measurement from historical data of how many hours before a catastrophic failure a failure alert was issued. In some embodiments, before the anomaly detection model is put into production use (e.g., during training of the anomaly detection model), the relationship between the input features, the projected cost savings 1102, and the alert hours before failure 1104 is adjusted based on input from subject matter experts.

In this example, if a transmission is run to failure, then the transmission is said to have experienced a catastrophic failure. For purposes of this example, a catastrophic failure costs $130,000 dollars to repair. After spending this $130,000 dollars to repair the catastrophic failure, the transmission runs for an average lifetime of twelve-hundred hours. Thus, in this scenario, the cost to repair is around $108 dollars per hour.

If a transmission is replaced or subject to some other remediation procedure that prevents the catastrophic failure, this a general repair and costs $23,000. Deploying the ML model (e.g., the anomaly detection model) as disclosed herein for real-time monitoring, analysis, and failure prediction, and transmissions are placed whenever the anomaly detection model triggers a failure alert, then there are four outcome cases in which the cost-saved metric plot 1100 demonstrates a predicted failure of a transmission and associated failure alert and scheduled remediation procedure using the ML model saving costs as measured in US dollars.

In the first case, an alert is issued just before an actual catastrophic failure. In some embodiments, this is the most preferable outcome. Converting the replacement or remediation procedure to a general repair saves the difference in cost between the general repair and the cost to repair a catastrophic failure. For example, if the general repair costs $50,000 dollars, then $80,000 dollars are saved. Further, as the transmission failure is predicted to occur just after the failure alert is issued, the replacement or remediation procedure is scheduled to occur such that a minimum amount of production time (or even no production time) is lost.

In the second case, an alert is issued and no failure occurs in the near future. In such cases, an unnecessary general failure is performed, costing $50,000. Additional miscellaneous costs of $23,000 are also incurred, resulting in a total, maximum cost of $73,000. This is represented in the cost-saved metric plot 1100 by the solid line, showing a maximum possible loss of $73,000 (the "plateau" or "plateau line"). As shown, this is preferable to, e.g., the cost of a catastrophic failure, shown as a dashed line. Further, in the second case, after general repair, the transmission continues to serve as a new transmission, so no runtime of the transmission is lost.

In the third case, a failure alert is issued, and without remediation the catastrophic failure of the transmission would occur in the near future. That is, there is more lead time between the failure alert based on the predicted failure of the transmission and the time of the actual catastrophic failure than in the first case. Converting the replacement or remediation procedure to a general repair saves the difference in cost between the general repair and the cost to repair a catastrophic failure. For example, if the general repair costs $50,000 dollars, then $80,000 dollars are saved. However, in this scenario some amount of usable transmission runtime is lost, as catastrophic failure is not imminent. In some such embodiments, the value of this lost runtime is measured in the hourly cost of repair (e.g., $108 dollars) multiplied by the amount of lost runtime in hours.

In the fourth case, no failure alert is issued, but the transmission still fails. As no alert was issued, zero cost is saved. Further, this scenario lowers the overall average cost saved per deployed transmission. Historical data, as described elsewhere herein, recording instances of the fourth case is usable in embodiments that recite at least training an ML model, both to train the ML model to avoid false positive predictions (e.g., false predictions of transmission failure) and to validate such training, as described elsewhere herein.

In light of the foregoing, the first case and third case represent desired behaviors of trained, deployed ML models (e.g., the anomaly detection model) as described herein. However, prior to deployment, all four cases have value in determining which type of ML model to choose for deployment based on historical data. For example, for any given model and set of historical data, only two points (a time at which a model predicted a transmission failure and an actual time of failure based on the historical data) are needed to convert the model performance into an estimated cost savings in US dollars.

Turning now to FIGS. 12A and 12B, tabular views illustrating an exemplary characteristic frequency calculation 1200 using planetary gears under various gears of a transmission according to an embodiment of the disclosure are described. This calculation uses example data that is not intended to limit the systems and methods disclosed herein in any way and is provided for illustrative purposes only. At each of the first gear through the eighth gear, characteristic vibrations for four planetary gears P1 through P4 are shown. Multiplying the "Pn_GMF/T_wo" value—where n is the number of the planetary gear, "Pn_GMF" is the gear mesh frequency of planetary gear n measured in hertz (Hz), and T_wo is the RPM of driven planet gears of the planetary gear n when the sun gear of the planetary gear n is rotating at T_wi RPM—by the transmission RPM (equal to T_wi), provides the base frequency of the characteristic vibration. The vibration amplitude for this frequency is recorded in the spectra, as described elsewhere herein. In some embodiments, the vibration amplitude is measured every thirty minutes. These amplitudes and associated transformations thereof are used as features by the anomaly detection model disclosed herein. In some embodiments, planetary gear Pn is an embodiment of the planetary gear system 600 disclosed elsewhere herein.

Turning now to FIG. 13, a tabular view illustrating an exemplary characteristic frequency calculation 1300 using planetary gears under various gears of a transmission according to an embodiment of the disclosure is described. In some embodiments, the exemplary characteristic frequency calculation 1300 provides an additional, complementary visualization of the data presented in FIG. 12 and the associated discussion herein. The exemplary transmission associated with the characteristic frequency calculation 1300 provides multiple gear selections, including a first gear 1302, a second gear 1304, a third gear 1306, a fourth gear 1308, a fifth gear 1310, a sixth gear 1312, a seventh gear 1314, and an eighth gear 1316. For each of the first gear 1302, the second gear 1304, the third gear 1306, the fourth gear 1308, the fifth gear 1310, the sixth gear 1312, the seventh gear 1314, and the eighth gear 1316, the engaged status of each planetary gear of a first planetary gear, a second planetary gear, a third planetary gear, and a fourth planetary gear in the transmission is indicated. Each planetary gear, depending on the gear selection, is either engaged, disengaged, or engaged but working as a fixed gear such that no CF(s) are generated by that particular planetary gear.

Figure 14:
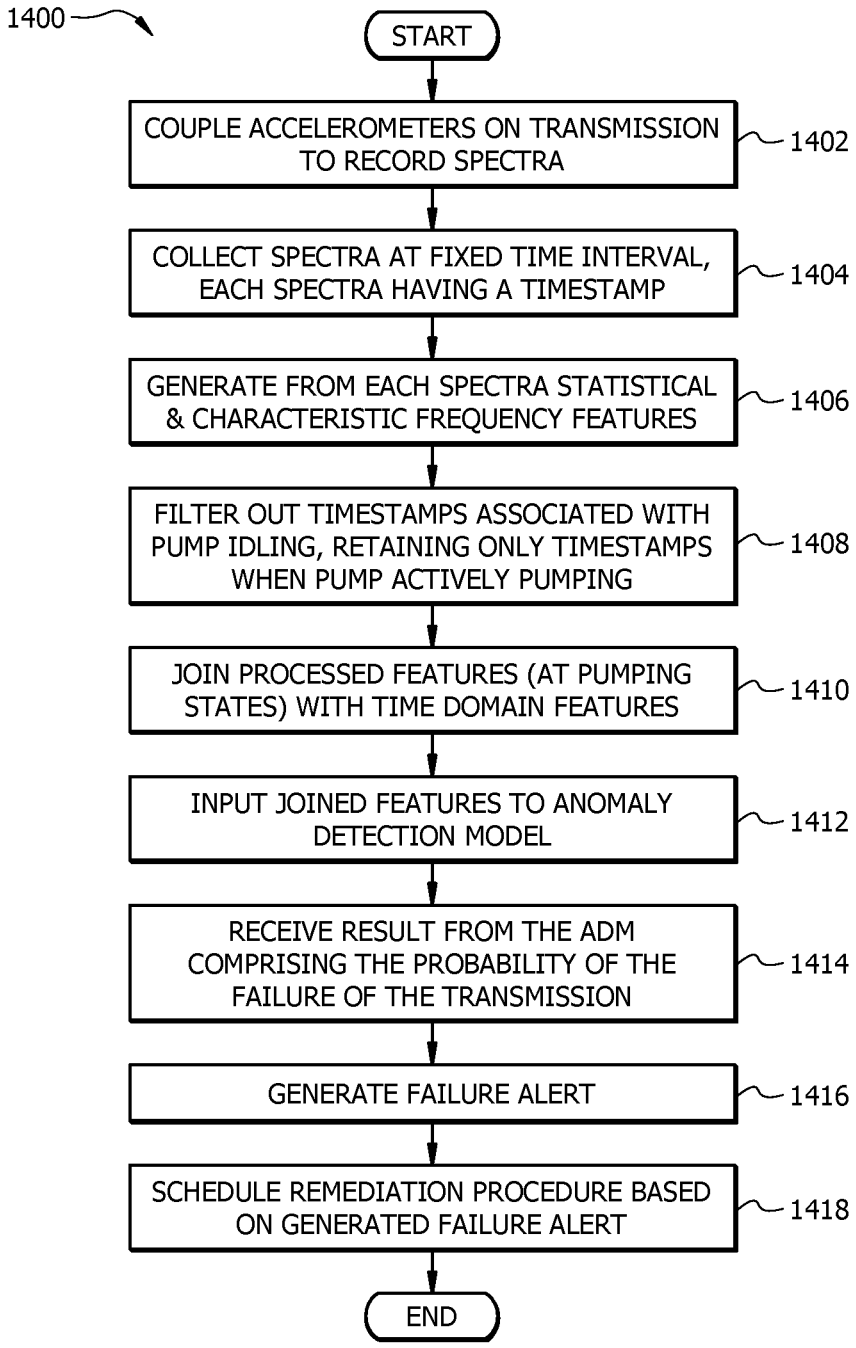
FIG. 14 is a flow chart illustrating a method for managing a maintenance schedule of an operational transmission of a reciprocating fracturing pump according to an embodiment of the disclosure.

Turning now to FIG. 14, a method 1400 for managing a maintenance schedule of an operational transmission of a reciprocating fracturing pump according to an embodiment of the disclosure is described. The transmission has a plurality of planetary gears. The transmission is mechanically coupled at a first end to a power source of a reciprocating fracturing pump and mechanically coupled at a second end to a pump power end of the reciprocating fracturing pump. In some embodiments, the power source is an electric motor. In other embodiments, the power source is a combustion engine. The transmission is configured to transfer a power output from the power source to the reciprocating fracturing pump and the reciprocating fracturing pump is configured to deliver a high-pressure fracturing fluid down a borehole at a wellsite.

The method 1400 comprises, at operation 1402, coupling a plurality of accelerometers to the transmission. Each accelerometer of the plurality of accelerometers is configured to record a plurality of spectra. In some embodiments, the plurality of accelerometers comprises a first accelerometer, a second accelerometer, a third accelerometer, a fourth accelerometer, and a fifth accelerometer. The first accelerometer and the second accelerometer are configured to record at least one spectra of the plurality of spectra in a horizontal direction. The third accelerometer and the fourth accelerometer are configured to record at least one spectra of the plurality of spectra in a vertical direction. A fifth accelerometer is configured to record at least one spectra of the plurality of spectra in an axial direction. In such embodiments, the plurality of planetary gears comprises a first planetary gear, a second planetary gear, a third planetary gear, and a fourth planetary gear. In some such embodiments, the fixed time interval is one second.

At operation 1404, the method 1400 further comprises collecting each spectra of the plurality of spectra at a fixed time interval, each spectra having a timestamp. At operation 1406, generating from each spectra of the plurality of spectra (a) statistical features of each spectra and (b) characteristic frequency (CF) features of each spectra. In some embodiments, the statistical features are associated with a measured state of the transmission, and the CF features are associated with a likelihood of a presence of CFs. The CFs are generated by a meshing of the plurality of planetary gears and indicate a likelihood of failure of the transmission. In some such embodiments, the statistical features and CF features in combination indicate a likelihood of failure of the transmission. In other embodiments, the statistical features of each spectra further comprising a mean, a median, a variance, a standard deviation, a kurtosis, a skewness, a root mean square (RMS) value, a crest factor, a frequency center, and a root mean square (RMS) frequency.

At operation 1408, the method 1400 removes the statistical features and the CF features of each target spectra of the plurality of spectra. Each target spectra has a timestamp corresponding to an idle time of the reciprocating fracturing pump. Operation 1408 thus retains a plurality of processed features.

At operation 1410, the method 1400 further comprises creating a plurality of joined features by joining the plurality of processed features with a plurality of time domain features. At operation 1412, the plurality of joined features are input into an anomaly detection model (ADM). In some embodiments, the ADM is a type of machine learning model selected to enhance an accuracy of the probability of failure of the transmission based on a deployment environment of the transmission. The ADM is configured to identify at least one outlier data point in the plurality of joined features. The identified at least one outlier data point indicates a probability of a failure of the transmission. At operation 1414, receiving a result from the ADM. The result comprises the probability of the failure of the transmission.

The method 1400 additionally comprises, at operation 1416, post-processing the result to generate a failure alert. In some embodiments, post-processing the result further comprises generating the failure alert based on a number of times each joined feature in the plurality of joined features exceeds a predefined threshold of anomaly probability associated with each joined feature.

At operation 1418, the method 1400 additionally comprises, based on the generated failure alert, scheduling, within a remediation time window, a remediation procedure. The remediation time window is before a catastrophic failure of the transmission.

Figure 15:
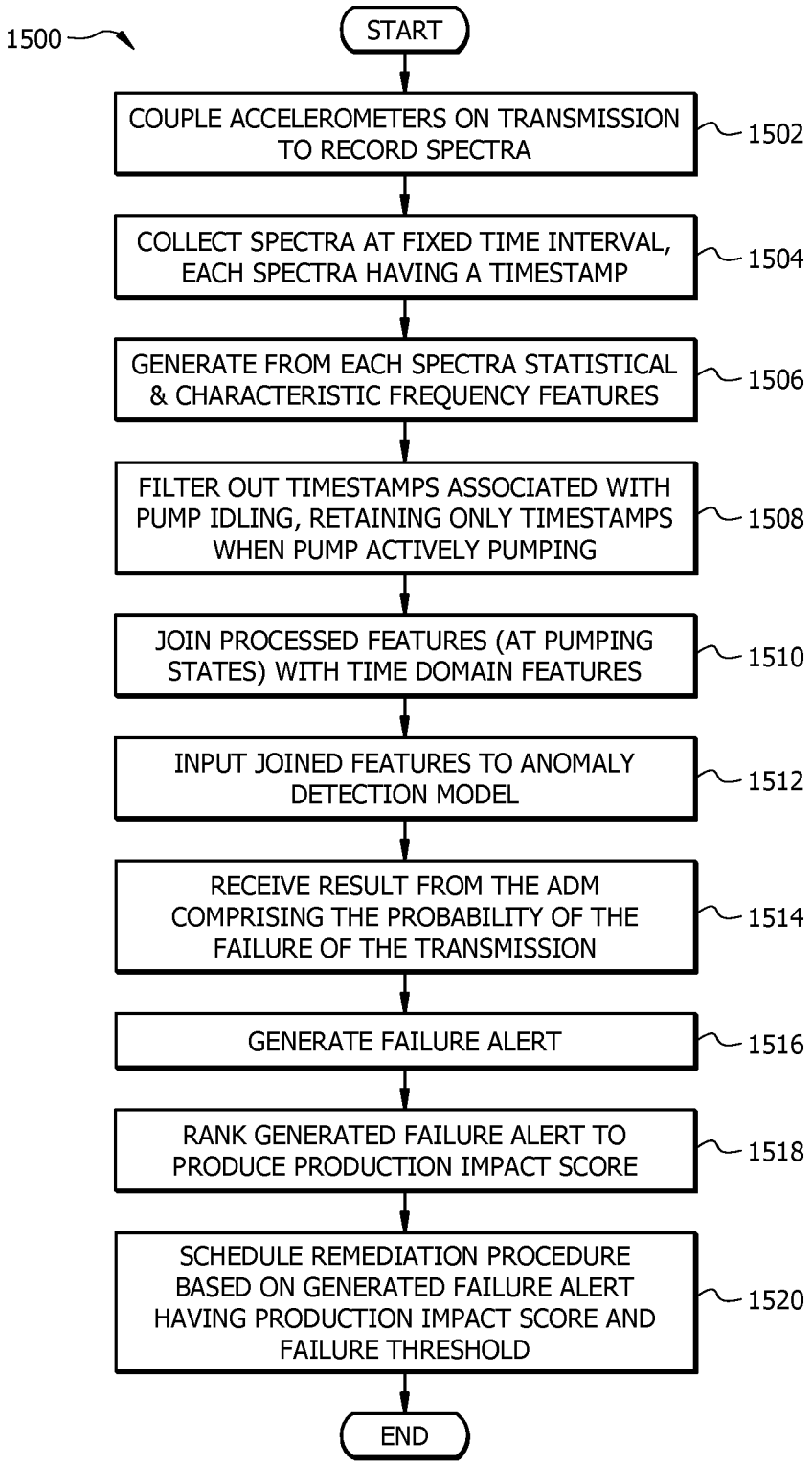
FIG. 15 is a flow chart illustrating an alternative method for managing a maintenance schedule of an operational transmission of a reciprocating fracturing pump based on a production impact score and a failure threshold according to an embodiment of the disclosure.

Turning now to FIG. 15, an alternative method for managing a maintenance schedule of an operational transmission of a reciprocating fracturing pump based on a production impact score and a failure threshold according to an embodiment of the disclosure is described. The transmission has a plurality of planetary gears. The transmission is mechanically coupled at a first end to a power source of a reciprocating fracturing pump and mechanically coupled at a second end to a pump power end of the reciprocating fracturing pump. In some embodiments, the power source is an electric motor. In other embodiments, the power source is a combustion engine. The transmission is configured to transfer a power output from the power source to the reciprocating fracturing pump and the reciprocating fracturing pump is configured to deliver a high-pressure fracturing fluid down a borehole at a wellsite.

The method 1500 comprises, at operation 1502, coupling a plurality of accelerometers to the transmission. Each accelerometer of the plurality of accelerometers is configured to record a plurality of spectra. In some embodiments, the plurality of accelerometers comprises a first accelerometer, a second accelerometer, a third accelerometer, a fourth accelerometer, and a fifth accelerometer. The first accelerometer and the second accelerometer are configured to record at least one spectra of the plurality of spectra in a horizontal direction. The third accelerometer and the fourth accelerometer are configured to record at least one spectra of the plurality of spectra in a vertical direction. The fifth accelerometer is configured to record at least one spectra of the plurality of spectra in an axial direction. In such embodiments, the plurality of planetary gears comprises a first planetary gear, a second planetary gear; a third planetary gear; and a fourth planetary gear.

At operation 1504, the method 1500 further comprises collecting each spectra of the plurality of spectra at a fixed time interval, each spectra having a timestamp. At operation 1506, generating from each spectra of the plurality of spectra (a) statistical features of each spectra and (b) characteristic frequency (CF) features of each spectra. In some embodiments, the statistical features are associated with a measured state of the transmission; and the CF features are associated with a likelihood of a presence of CFs, the CFs being generated by a meshing of the plurality of planetary gears and indicating a likelihood of failure of the transmission. In some embodiments, the statistical features of each spectra further comprise a mean, a median, a variance, a standard deviation, a kurtosis, a skewness, a root mean square (RMS) value, a crest factor, a frequency center, and a root mean square (RMS) frequency.

At operation 1508, removing the statistical features and the CF features of each target spectra of the plurality of spectra. Each target spectra has a timestamp corresponding to an idle time of the reciprocating fracturing pump, and retaining a plurality of processed features. At operation 1510, creating a plurality of joined features by joining the plurality of processed features with a plurality of time domain features.

At operation 1512, the method 1500 further comprises inputting the plurality of joined features into an anomaly detection model (ADM). In some embodiments, the ADM is a type of ML model selected to enhance an accuracy of the probability of failure of the transmission based on a deployment environment of the transmission. The ADM is configured to identify at least one outlier data point in the plurality of joined features. The identified at least one outlier data point indicates a probability a failure of the transmission. At operation 1514, receiving a result from the ADM. The result comprises the probability of the failure of the transmission.

At operation 1516, the method 1500 additionally comprises post-processing the result to generate a failure alert. In some embodiments, post-processing the result further comprises generating the failure alert based on a number of times each joined feature in the plurality of joined features exceeded a predefined threshold of anomaly probability associated with each joined feature.

At operation 1518, ranking the generated failure alert to produce a production impact score. The production impact score is based at least in part on the probability of the failure of the transmission being beyond a failure threshold. In some embodiments, the production impact score is based on a prediction of how much of a usable production time at the wellsite is lost during the remediation procedure. The usable production time being an amount of time when the wellsite is producing an oil, a gas, or an other product in a paying quantity. In some such embodiments, the failure threshold is at least one of a predefined or a tunable threshold probability of an anomaly being present and the anomaly causing the failure of the transmission. In these embodiments, a comparison of the production impact score and the failure threshold predicts that scheduling a remediation procedure increases the usable production time at the wellsite compared to an impact on the usable production time at the wellsite from the transmission experiencing a catastrophic failure.

At operation 1520, based on the production impact score, scheduling, within a remediation time window, a remediation procedure. The remediation time window is before a catastrophic failure of the transmission.

Figure 16:
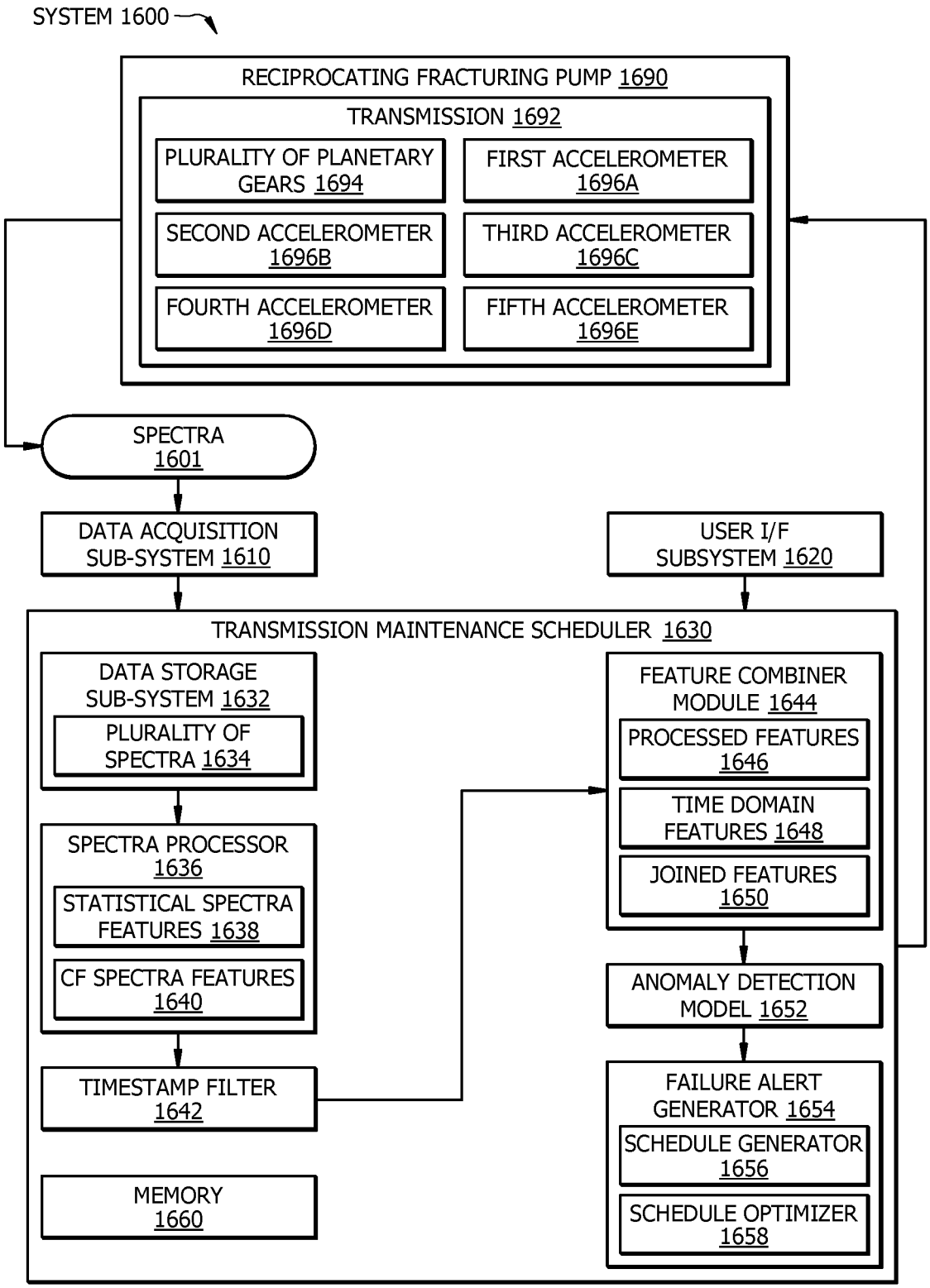
FIG. 16 is a block diagram illustrating a system a maintenance schedule of an operational transmission of a reciprocating fracturing pump based on a production impact score and a failure threshold according to an embodiment of the disclosure.

Turning now to FIG. 16, a block diagram illustrating a system 1600 for managing a maintenance schedule of an operational transmission 1692 of a reciprocating fracturing pump 1690 based on a production impact score and a failure threshold according to an embodiment of the disclosure is described. The reciprocating fracturing pump 1690 is fluidically connected to a wellbore at a wellsite. the transmission 1692 has a plurality of planetary gears 1694 and is mechanically coupled at a first end to a power source of the reciprocating fracturing pump 1690 and mechanically coupled at a second end to a pump power end of the reciprocating fracturing pump 1690. The transmission 1692 is further configured to transfer a power output from the power source to the reciprocating fracturing pump 1690. The reciprocating fracturing pump 1690 is configured to deliver a high-pressure fracturing fluid down the borehole.

The system 1600 further comprises a plurality of spectrometers 1696 coupled to the transmission 1692. Each accelerometer of the plurality of accelerometers 1696 is configured to record a plurality of spectra 1634. A data acquisition subsystem 1610 is communicatively coupled to each accelerometer of the plurality of accelerometers 1696, and further coupled to a data storage subsystem 1632.

The system 1600 additionally comprises a transmission maintenance scheduler 1630 of the reciprocating fracturing pump 1690 and a non-transitory memory 1660. The transmission maintenance scheduler 1630 is configured to collect, using the data acquisition subsystem 1610, each spectra of the plurality of spectra 1634 at a fixed time interval. Each spectra has a timestamp. The transmission maintenance scheduler 1630 is further configured to store the collected plurality of spectra 1634 in the data storage subsystem 1632. The transmission maintenance scheduler 1630 generates, using a spectra processor 1636, from each spectra of the plurality of spectra 1634, (a) statistical features 1638 of each spectra and (b) characteristic frequency (CF) features 1640 of each spectra. Using a timestamp filter 1642, the transmission maintenance scheduler 1630 removes the statistical features 1638 and the CF features 1640 of each target spectra of the plurality of spectra. Each target spectra having a timestamp corresponding to an idle time of the reciprocating fracturing pump 1690, and retains a plurality of processed features 1646.

The transmission maintenance scheduler 1630 additionally comprises a feature combiner module 1644 used to create a plurality of joined features 1650 by joining the plurality of processed features 1646 with a plurality of time domain (TD) features 1648. The plurality of joined features 1650 are input into an anomaly detection model (ADM) 1652. the ADM 1652 is configured to identify at least one outlier data point in the plurality of joined features. The identified at least one outlier data point indicating a probability of a failure of the transmission. In some embodiments, the ADM 1652 is a type of machine learning model selected to enhance an accuracy of the probability of failure of the transmission based on a deployment environment of the transmission 1692.

The transmission maintenance scheduler 1630 receives a result from the ADM 1652. The result comprises the probability of the failure of the transmission 1692. The transmission maintenance scheduler 1630 post-processes, using a failure alert generator 1654 comprising a schedule generator 1656 and a schedule optimizer 1658, the result to generate a failure alert. Based on the generated failure alert, the schedule generator 1656 schedules a remediation procedure.

In some embodiments, the schedule optimizer 1658 is further configured to rank the generated failure alert to produce a production impact score. The production impact score is based on a prediction of how much of a usable production time at the wellsite is lost during the remediation procedure. The usable production time is an amount of time when the wellsite is producing an oil, a gas, or an other product in a paying quantity. The schedule optimizer 1658 further sets a failure threshold. The failure threshold is a predefined threshold probability of an anomaly being present and the anomaly causing the failure of the transmission 1692. The schedule optimizer 1658 additionally determines determine that a comparison of the production impact score and the failure threshold predicts that scheduling a remediation procedure increases the usable production time at the wellsite compared to an impact on the usable production time at the wellsite from the transmission experiencing a catastrophic failure, and confirms a date and a time of the scheduled remediation procedure. The remediation procedure comprises, in response to the comparison of the production impact score and the failure threshold, at least one of: (1) changing an operating condition of the transmission 1692, and (2) conducting a general repair on the transmission 1692, and (3) replacing the transmission 1692.

Some embodiments of the system 1600 further comprise displaying to a user, by way of a user interface subsystem 1620 (also referred to as a user I/F subsystem) comprising a graphical display interface, the failure alert of the transmission 1962. In some such embodiments, the system 1600 displays to a user, by way of a graphical display interface, the generated failure alert of the transmission 1692. In some such embodiments, the graphical display interface is incorporated into a user interface subsystem 1620. In some embodiments, the graphical display interface receives data from at least one component of the system 1600 disclosed herein, including but not limited to the transmission 1692, the first accelerometer 1696A, second accelerometer 1696B, the third accelerometer 1696C, the fourth accelerometer 1696D, the fifth accelerometer 1696E, the feature alert generator 1654, the schedule generator 1656, the schedule optimizer 1658, the anomaly detection model 1652, the data acquisition sub-system 1610, and the data storage subsystem 1632. The graphical display interface forms displays of at least one of the various types of data disclosed herein, including but not limited to the plurality of spectra 1634 and the operating condition of the transmission 1692, the processed features 1646, the time domain features 1648, and the joined features 1650.

Figure 17:
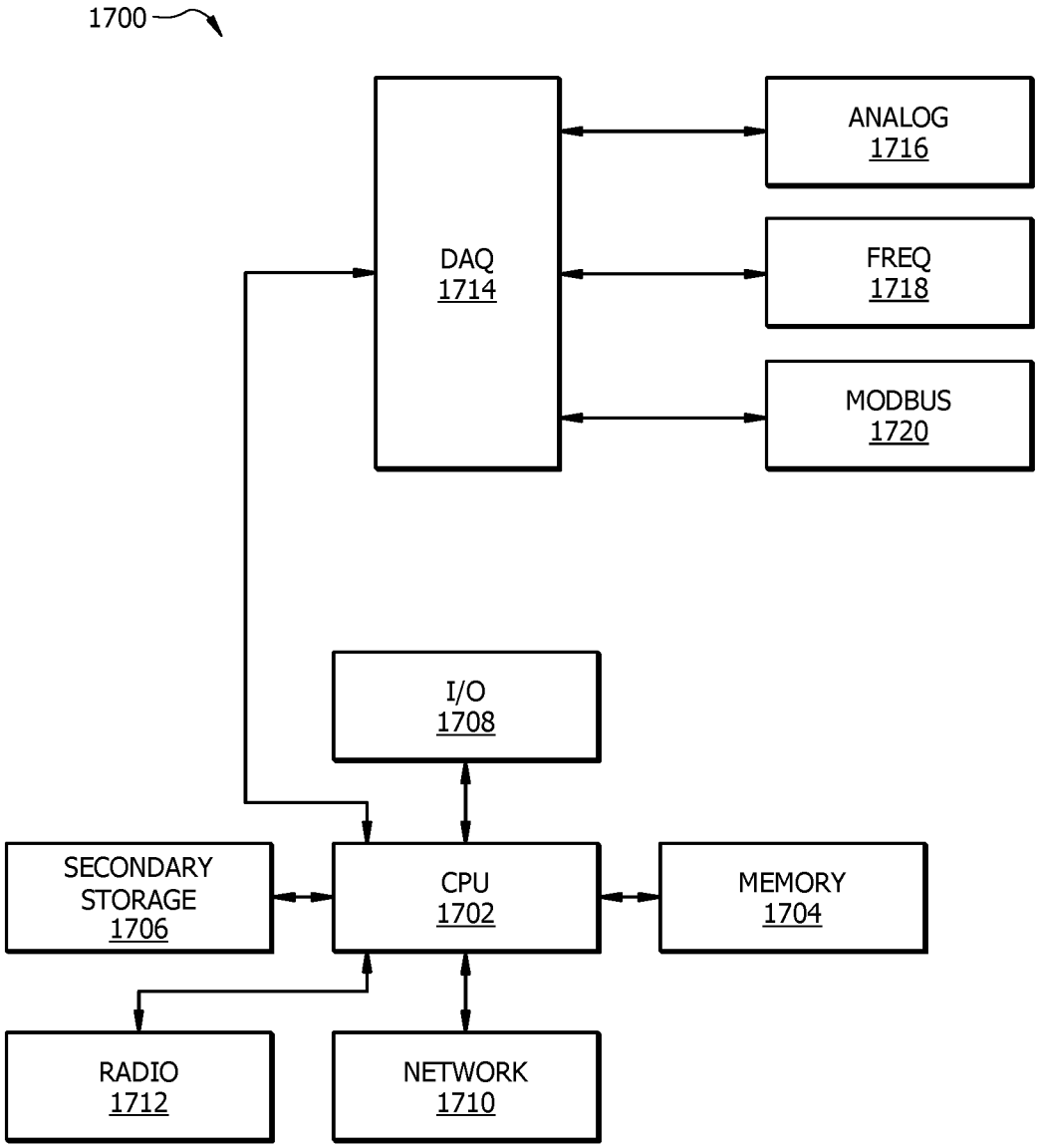
FIG. 17 is a block diagram illustrating a computer system according to an embodiment of the disclosure.

Turning now to FIG. 17, a computer system 1700 according to an embodiment of the disclosure is described. In some embodiments, the computer system 1700 is referred to interchangeably as the "unit controller 1700." In some embodiments, the computer system 1700 is at least one of (or at least a component of) the transmission maintenance scheduler 1630 of the system 1600, the wellbore services management trailer 404 of the wellbore servicing system 400, or any other computer system or combination of computer systems configured to execute the method 1400 or the method 1500 described herein. In particular, in some embodiments, the terms unit controller or computer system 1700 are interchangeable with the term "transmission maintenance scheduler 1630." In some embodiments, the computer system 1700 is communicatively connected to embodiments of at least one of the pump 10, the transmission 500, the planetary gear 600, the plurality of accelerometers 700, or the system 1600 as disclosed herein.

Embodiments of the computer system 1700 are suitable for implementing one or more embodiments of a remote computer system, for example, a cloud computing system, a virtual network function (VNF) on a network slice of a cloud computing platform, and a plurality of user devices. The computer system 1700 includes one or more processors 1702 (each also referred to as a "central processor unit," "central processing unit," or CPU) that is in communication with a memory 1704, a secondary storage 1706, input/output devices 1708, and network devices 1710. Embodiments of the computer system 1700 continuously monitor the state of the input devices and change the state of the output devices based on a plurality of programmed instructions. In some embodiments, the programmed instructions comprise one or more applications retrieved from the memory 1704 for executing by the processor 1702 in the non-transitory memory 1704 within the memory 1704. In some embodiments, the input/output devices 1708 comprise a Human Machine Interface with a display screen and the ability to receive conventional inputs from a user such as push button, touch screen, keyboard, mouse, or any other such device or element that a user utilizes to input a command to the computer system 1700. In some embodiments, the secondary storage 1706 comprises at least one of a solid-state memory, a hard drive, or any other type of memory suitable for data storage. In some such embodiments, the secondary storage 1706 additionally optionally comprises at least one of removable memory storage devices such as solid-state memory or removable memory media such as magnetic media and optical media, i.e., CD disks.

The computer system 1700 is configured to communicate with various networks utilizing the network devices 1710. In some embodiments, the various networks comprise wired networks utilizing at least one of, e.g., twisted-pair ethernet, direct attach cable (DAC cable), or fiber optic communications equipment, or any other type of wired networking equipment with substantially similar performance characteristics. In other embodiments, the various networks comprise at short range wireless networks such as Wi-Fi (i.e., the IEEE 802.11 family of standards), Bluetooth, or other low power wireless signals such as ZigBee, Z-Wave, 6LoWPan, Thread, and Wi-Fi HaLow, or any other type of wireless networking equipment with substantially similar performance characteristics. In yet other embodiments, the various networks comprise a combination of wired networks and wireless networks as described above. Some embodiments of the computer system 1700 include a long-range radio transceiver 1712 for communicating with mobile network providers.

In some embodiments, the computer system 1700 comprises a data acquisition (DAQ) card 1714 for communication with one or more sensors. In some such embodiments, the DAQ card 1714 is a standalone system with a microprocessor, memory, and one or more applications executing in memory. In some embodiments, the DAQ card 1714, as illustrated, is at least one of a card or a device within the computer system 1700. In some embodiments, the DAQ card 1714 is combined with the input/output device 1708. In some embodiments, the DAQ card 1714 receives one or more analog inputs 1716, one or more frequency inputs 1718, and one or more Modbus inputs 1720. For example, the analog input 1716 may include a volume sensor, e.g., a tank level sensor. In some examples, the frequency input 1718 includes a flow meter, i.e., a fluid system flowrate sensor. In some examples, the modbus input 1720 includes a pressure transducer. In some embodiments, the DAQ card 1714 converts the signals received via the analog input 1716, the frequency input 1718, and the modbus input 1720 into the corresponding sensor data. For example, some embodiments of the DAQ card 1714 convert a frequency input 1718 from the flowrate sensor into flow rate data measured in gallons per minute (GPM).

The systems and methods disclosed herein may be advantageously employed in the context of wellbore servicing operations, particularly, in relation to scheduling maintenance of a pump transmission based on predicting the failure of the transmission as described herein.

In some embodiments, systems and methods disclosed herein, including the method 1400 or any process executing on the computer system 1700 enables managing a maintenance schedule of an operational transmission. These systems and methods comprise: coupling a plurality of accelerometers to the transmission, each accelerometer of the plurality of accelerometers being configured to record a plurality of spectra; collecting each spectra of the plurality of spectra at a fixed time interval, each spectra having a timestamp; generating from each spectra of the plurality of spectra (a) statistical features of each spectra and (b) characteristic frequency (CF) features of each spectra; removing the statistical features and the CF features of each target spectra of the plurality of spectra, each target spectra having a timestamp corresponding to an idle time of the reciprocating fracturing pump, and retaining a plurality of processed features; creating a plurality of joined features by joining the plurality of processed features with a plurality of time domain features; inputting the plurality of joined features into an anomaly detection model (ADM), the ADM configured to identify at least one outlier data point in the plurality of joined features, the identified at least one outlier data point indicating a probability of a failure of the transmission; receiving a result from the ADM, the result comprising the probability of the failure of the transmission; post-processing the result to generate a failure alert; and based on the generated failure alert, scheduling, within a remediation time window, a remediation procedure, the remediation time window being before a catastrophic failure of the transmission.

Additional Disclosure

As disclosed herein, the ML models used in various embodiments at least generate failure alerts upon predicting an impending failure as described elsewhere herein. When mitigation procedures are scheduled based on such generated failure alerts, the type of costly and time-consuming complete overhaul or replacement associated with a failed transmission is unnecessary. Instead, in some embodiments, a simpler general repair, as that term is understood in the art and described herein, is a sufficient remediation procedure. Likewise, as demonstrated throughout this disclosure, using the disclosed ML model or the disclosed ML model in combination with a production impact score (including the cost saved metric variation of the production impact score) improves maintenance schedules and thus maximizes production time for a pump associated with a transmission monitored for failure prediction as described herein.

The systems and methods disclosed herein are not restricted to use with a specific ML model, but rather are usable with any ML models compatible with the inputs discussed herein and capable of delivering the output discussed herein. Various pumps and associated infrastructure as described herein exhibit differing behaviors and have differing lifetimes or mean times between failures based on a variety of factors. These factors include but are not limited to general environmental characteristics of a well site, weather and climate at a well site, characteristics of the products and other materials being produced from a wellbore using equipment including at least a pump having a transmission, and any other factor or characteristic of an operational pump deployment that tends to impact the lifetime of the deployed operational pump. Collectively, such factors and characteristics are referred to as "lifetime indicators." Embodiments of the disclosed systems and methods contemplate that an ML model used to predict transmission failure as described herein at a specific wellsite is selected based on these lifetime factors, such that the selected ML model produces more accurate failure predictions (which in turn informs the associated production impact scoring) compared to at least one unused ML model that delivers less accurate predictions when the same lifetime indicators are present.

ML models usable with the disclosed systems and methods of predicting transmission failure of a pump include both supervised models and unsupervised models. Some embodiments herein are configured to utilize at least one of rule-based statistical models, long short-term memory (LSTM) models, and anomaly detection models. Embodiments herein contemplate that models selected to predict transmission failure as described herein are optimized for accuracy of the prediction over the speed of the prediction.

Additionally, in some embodiments, matching a recorded failure prediction accuracy of a specific model and associated accuracy of the generated production impact score with information on whether, how, and when the transmission under analysis actually needed remediation procedures within the indicated remediation time window enables a user to directly evaluate the effectiveness of a specific ML model for a wellsite having a specific set of lifetime indicators. The ability to perform such evaluations enhances the overall efficiency wellsite maintenance and in turn also enhances the efficiency of the production of products from the wellsite.

In light of the foregoing, in some embodiments, an ML model is at least one of selected, tuned, or otherwise improved based on optimizing the ML model performance by adding a customized value optimization function evaluation metric in the form of the production impact score as disclosed herein. Also, as disclosed herein, in some embodiments the production impact score is in the form of a cost saved metric. Such evaluation metrics incorporate a real-world value to the model and enable maximizing a desirable effect using the ML model. In some embodiments, this desirable effect is a positive business impact. Positive business impacts include but are not limited to at least reduced operational costs or increased profits based on a scheduled remedial procedure conducted on a pump which has not yet experienced catastrophic transmission failure being faster and less expensive than rebuilding or replacing a pump that has experienced catastrophic transmission failure. Operational costs are reduced, for example, when it is less expensive to conduct the remediation procedure than a complete rebuild or replacement of a catastrophically failed transmission. Profits are increased when the remediation procedure is faster than a complete rebuild or replacement of a catastrophically failed transmission, allowing production from the impacted well to resume faster than if the pump or the catastrophically failed transmission within the pump needed replacement.

In some embodiments disclosed herein, the cost-saved metric is non-limiting implementation of the production impact score as described herein. Other embodiments calculate a prediction impact score without using the cost-saved metric or alternatively combining the cost-saved metric with a second metric configured to measure production impact.

Embodiments herein refer to a remediation procedure. See, as non-limiting examples, operation 1418 of the method 1400, operation 1520 of the method 1500, the schedule generator 1656 and schedule optimizer 1658 of the system 1600, and all other discussions of remediation procedures herein. In such embodiments, the remediation procedure comprises changing, in response to a failure alert, an operating condition transmission. In some embodiments, changing the operating condition includes any action that tends to mitigate at least one operating condition indicated by an outlier data point in the plurality of joined features as contributing to the predicted probability of failure of the transmission. For example, remediation procedures include but are not limited to shifting the gear of the transmission (e.g., shifting from eighth gear to first gear, etc.) to reduce strain on the transmission.

In some embodiments using anomaly detection models to predict transmission failures as described herein, the anomaly detection model analyzes at least five-hundred hours of feature input before making failure predictions. In some embodiments, this increases the accuracy of the failure predictions.

In other embodiments using the anomaly detection model, if a probability of an anomaly (indicating a likelihood of an upcoming transmission failure) is more than a tunable threshold probability (e.g., 0.5 or fifty percent) then an anomaly is considered to be detected and a failure alert is issued. In some such embodiments, this threshold is tunable or subject to refinement over a period of time to make adjustments for a specific use case, a specific model implementation, excess false negatives, excess false positives, etc.

While some traditional contemporary techniques have operated at the level of bands of CFs to attempt to predict transmission failures (e.g., analyzing a range of CFs as a whole), the disclosed systems and methods make failure predictions based on analyzing the presence of specific individual CF values detected from the planetary gears of a transmission. Analysis that is based on a band of CFs where observed CF datapoints is only capable of delivering non-specific output that applies to any data points lying in that range. This lack of specificity makes such output too inaccurate and too disconnected from real conditions represented by actual datapoints to be useful to make transmission failure predictions for pumps associated with operational wellbores and related infrastructure. Thus, by generating specific actual CFs, the disclosed systems and methods enable transmission failure prediction that is based on a more precise representation of real-world conditions, which in turn allows for generating more accurate transmission failure predictions.

The systems and methods disclosed herein contemplate no restrictions on spectra amplitude values or time domain features usable to predict transmission failure. Any such value measurable from an engaged planetary gear is usable with the systems and methods disclosed herein. Further, time domain features as described herein include RPM, engine oil temperature, temperature of a coolant, and any other physical property of transmission measurable at a specific time. Likewise, non-statistical feature extraction collects any features directly measurable from the sensors (e.g., accelerometers), including but not limited to: RPM, engine oil temperature, torque, pressure, and other such features disclosed herein.

In the systems and methods disclosed herein, gear mesh frequencies (GMFs) are utilized. To calculate a GMF for a given planetary gear at a given time, the number of teeth in the planetary gear are multiplied by the RPM of the gear.

In some embodiments, the efficacy of a particular ML model to predict transmission failure is testable using A/B testing. That is, comparing the catastrophic failure rates of a set of control group transmissions running without any failure prediction versus the catastrophic failure rate of a set of transmissions running, subjected to remediation procedures, repaired, replaced, etc. based on failure prediction as described herein.

In embodiments of the systems and methods disclosed herein, in order to predict the failure of a transmission an ML model utilizes historical data about known transmission failures. The historical data includes, for every recorded transmission failure, the time of failure and whether the failure was predicted by manual failure analysis and evaluation processes. Additionally, for each failure in the historical data, the probable reason for failure is available. Usable historical data sets contain data on a minimum of one-hundred-and-ten failed transmissions, of which only (fifty to fifty-five transmissions need to have good data integrity.

The following are non-limiting, specific embodiments in accordance with the present disclosure:

A first embodiment, which is a method for managing a maintenance schedule of an operational transmission, the transmission having a plurality of planetary gears and being mechanically coupled at a first end to a power source of a reciprocating fracturing pump and mechanically coupled at a second end to a crankshaft of the reciprocating fracturing pump, the transmission configured to transfer a power output from the power source to the reciprocating fracturing pump and the reciprocating fracturing pump configured to deliver a high pressure fracturing fluid down a borehole at a wellsite, the method comprising: coupling a plurality of accelerometers to the transmission, each accelerometer of the plurality of accelerometers being configured to record a plurality of spectra; collecting each spectra of the plurality of spectra at a fixed time interval, each spectra having a timestamp; generating from each spectra of the plurality of spectra (a) statistical features of each spectra and (b) characteristic frequency (CF) features of each spectra; removing the statistical features and the CF features of each target spectra of the plurality of spectra, each target spectra having a timestamp corresponding to an idle time of the reciprocating fracturing pump, and retaining a plurality of processed features; creating a plurality of joined features by joining the plurality of processed features with a plurality of time domain features; inputting the plurality of joined features into an anomaly detection model (ADM), the ADM configured to identify at least one outlier data point in the plurality of joined features, the identified at least one outlier data point indicating a probability of a failure of the transmission; receiving a result from the ADM, the result comprising the probability of the failure of the transmission; post-processing the result to generate a failure alert; and based on the generated failure alert, scheduling, within a remediation time window, a remediation procedure, the remediation time window being before a catastrophic failure of the transmission.

A second embodiment, which is the method of the first embodiment, wherein the power source is an electric motor.

A third embodiment, which is the method of the first embodiment, wherein the power source is a combustion engine.

A fourth embodiment, which is the method of the first embodiment, wherein: the plurality of accelerometers comprises a first accelerometer, a second accelerometer, a third accelerometer, a fourth accelerometer, and a fifth accelerometer; and further comprising: the first accelerometer and the second accelerometer being configured to record at least one spectra of the plurality of spectra in a horizontal direction, the third accelerometer and the fourth accelerometer being configured to record at least one spectra of the plurality of spectra in a vertical direction, and the fifth accelerometer being configured to record at least one spectra of the plurality of spectra in the axial direction; and the plurality of planetary gears comprising a first planetary gear, a second planetary gear, a third planetary gear, and a fourth planetary gear.

A fifth embodiment, which is the method of the fourth embodiment, wherein the fixed time interval is one second.

A sixth embodiment, which is the method of the first embodiment, wherein: the statistical features are associated with a measured state of the transmission; and the CF features are associated with a likelihood of a presence of CFs, the CFs being generated by a meshing of the plurality of planetary gears and indicating a likelihood of failure of the transmission.

A seventh embodiment, which is the method of the first embodiment, the statistical features of each spectra further comprising a mean, a median, a variance, a standard deviation, a kurtosis, a skewness, a root mean square (RMS) value, a crest factor, a frequency center, and a root mean square (RMS) frequency.

An eighth embodiment, which is the method of the first embodiment, post-processing the result further comprising generating the failure alert based on a number of times each joined feature in the plurality of joined features exceeds a predefined threshold of anomaly probability associated with each joined feature.

A ninth embodiment, which is the method of the first embodiment, wherein the ADM is a type of machine learning model selected to enhance an accuracy of the probability of failure of the transmission based on a deployment environment of the transmission.

A tenth embodiment, which is a method for managing a maintenance schedule of an operational transmission, the transmission having a plurality of planetary gears and being mechanically coupled at a first end to a power source of a reciprocating fracturing pump and mechanically coupled at a second end to a crankshaft of the reciprocating fracturing pump, the transmission configured to transfer a power output from the power source to the reciprocating fracturing pump and the reciprocating fracturing pump configured to deliver a high pressure fracturing fluid down a borehole at a wellsite, the method comprising: coupling a plurality of accelerometers to the transmission, each accelerometer of the plurality of accelerometers being configured to record a plurality of spectra; collecting each spectra of the plurality of spectra at a fixed time interval, each spectra having a timestamp; generating from each spectra of the plurality of spectra (a) statistical features of each spectra and (b) characteristic frequency (CF) features of each spectra; removing the statistical features and the CF features of each target spectra of the plurality of spectra, each target spectra having a timestamp corresponding to an idle time of the reciprocating fracturing pump, and retaining a plurality of processed features; creating a plurality of joined features by joining the plurality of processed features with a plurality of time domain features; inputting the plurality of joined features into an anomaly detection model (ADM), the ADM configured to identify at least one outlier data point in the plurality of joined features, the identified at least one outlier data point indicating a probability a failure of the transmission; receiving a result from the ADM, the result comprising the probability of the failure of the transmission; post-processing the result to generate a failure alert; ranking the generated failure alert to produce a production impact score based at least in part on the probability of the failure of the transmission being beyond a failure threshold; based on the production impact score, scheduling, within a remediation time window, a remediation procedure, the remediation time window being before a catastrophic failure of the transmission.

An eleventh embodiment, which is the method of the tenth embodiment, wherein the production impact score is based on a prediction of how much of a usable production time at the wellsite is lost during the remediation procedure, the usable production time being an amount of time when the wellsite is producing an oil, a gas, an other product in a paying quantity.

A twelfth embodiment, which is the method of the eleventh embodiment, further comprising: the failure threshold being at least one of a predefined or a tunable threshold probability of an anomaly being present and the anomaly causing the failure of the transmission; and wherein a comparison of the production impact score and the failure threshold predicts that scheduling a remediation procedure increases the usable production time at the wellsite compared to an impact on the usable production time at the wellsite from the transmission experiencing a catastrophic failure.

A thirteenth embodiment, which is the method of the tenth embodiment, wherein: the plurality of accelerometers comprises a first accelerometer, a second accelerometer, a third accelerometer, a fourth accelerometer, and a fifth accelerometer; and further comprising: the first accelerometer and the second accelerometer being configured to record at least one spectra of the plurality of spectra in a horizontal direction, the third accelerometer and the fourth accelerometer being configured to record at least one spectra of the plurality of spectra in a vertical direction, and the fifth accelerometer being configured to record at least one spectra of the plurality of spectra in an axial direction; and the plurality of planetary gears comprising a first planetary gear, a second planetary gear; a third planetary gear; and a fourth planetary gear.

A fourteenth embodiment, which is the method of the tenth embodiment, wherein: the statistical features are associated with a measured state of the transmission; and the CF features are associated with a likelihood of a presence of CFs, the CFs being generated by a meshing of the plurality of planetary gears and indicating a likelihood of failure of the transmission.

A fifteenth embodiment, which is the method of the tenth embodiment, the statistical features of each spectra further comprising a mean, a median, a variance, a standard deviation, a kurtosis, a skewness, a root mean square (RMS) value, a crest factor, a frequency center, and a root mean square (RMS) frequency.

A sixteenth embodiment, which is the method of the tenth embodiment, post-processing the result further comprising generating the failure alert based on a number of times each joined feature in the plurality of joined features exceeded a predefined threshold of anomaly probability associated with each joined feature.

A seventeenth embodiment, which is the method of the tenth embodiment, wherein the ADM is a type of machine learning model selected to enhance an accuracy of the probability of failure of the transmission based on a deployment environment of the transmission.

An eighteenth embodiment, which is a system for managing a maintenance schedule of an operational transmission, the system comprising: a reciprocating fracturing pump fluidically connected to a wellbore at a wellsite; the transmission having a plurality of planetary gears and being mechanically coupled at a first end to a power source of the reciprocating fracturing pump and mechanically coupled at a second end to crankshaft of the reciprocating fracturing pump; the transmission further being configured to transfer a power output from the power source to the reciprocating fracturing pump and the reciprocating fracturing pump configured to deliver a high-pressure fracturing fluid down the borehole; a plurality of spectrometers coupled to the transmission, each accelerometer of the plurality of accelerometers being configured to record a plurality of spectra; a data acquisition subsystem communicatively coupled to each accelerometer of the plurality of accelerometers, and further coupled to a data storage subsystem; a transmission maintenance scheduler of the reciprocating fracturing pump comprising a processor and a non-transitory memory, configured to: collect, using the data acquisition subsystem, each spectra of the plurality of spectra at a fixed time interval, each spectra having a timestamp; store the collected plurality of spectra in the data storage subsystem; generate, using a spectra processor, from each spectra of the plurality of spectra (a) statistical features of each spectra and (b) characteristic frequency (CF) features of each spectra; using a timestamp filter, remove the statistical features and the CF features of each target spectra of the plurality of spectra, each target spectra having a timestamp corresponding to an idle time of the fracturing pump, and retain a plurality of processed features; create, using a feature combiner module, a plurality of joined features by joining the plurality of processed features with a plurality of time domain features; input the plurality of joined features into an anomaly detection model (ADM), the ADM configured to identify at least one outlier data point in the plurality of joined features, the identified at least one outlier data point indicating a probability of a failure of the transmission; receive a result from the ADM, the result comprising the probability of the failure of the transmission; post-process, using a failure alert generator comprising a schedule generator and a schedule optimizer, the result to generate a failure alert; and based on the generated failure alert, schedule, using the schedule generator, a remediation procedure.

A nineteenth embodiment, which is the system of the eighteenth embodiment, wherein the schedule optimizer is further configured to: rank the generated failure alert to produce a production impact score, the production impact score being based on a prediction of how much of a usable production time at the wellsite is lost during the remediation procedure, the usable production time being an amount of time when the wellsite is producing an oil, a gas, or an other product in a paying quantity; set a failure threshold, the failure threshold being a predefined threshold probability of an anomaly being present and the anomaly causing the failure of the transmission; and determine that a comparison of the production impact score and the failure threshold predicts that scheduling a remediation procedure increases the usable production time at the wellsite compared to an impact on the usable production time at the wellsite from the transmission experiencing a catastrophic failure; and confirm a date and a time of the scheduled remediation procedure, the remediation procedure comprising, in response to the comparison of the production impact score and the failure threshold, at least one of: (1) changing an operating condition of the transmission, (2) conducting a general repair of the transmission, and (3) replacing the transmission.

A twentieth embodiment, which is the system of the eighteenth embodiment, wherein the ADM is a type of machine learning model selected to enhance an accuracy of the probability of failure of the transmission based on a deployment environment of the transmission; and further comprising displaying to a user, by way of a graphical display interface, the failure alert of the transmission.

A twenty-first embodiment, which is a method for operating a transmission (e.g., having a plurality of planetary gears) coupled to a pump (e.g., high pressure fracturing pump configured to deliver a high pressure fracturing fluid down a borehole at a wellsite), the method comprising: coupling a plurality of accelerometers to the transmission, each accelerometer of the plurality of accelerometers being configured to record a plurality of spectra; collecting, from a plurality of accelerometers coupled to the transmission, a plurality of spectra from each accelerometer; feature processing the plurality of spectra to identify a plurality of joined features; inputting the plurality of joined features into an anomaly detection model (ADM), the ADM configured to identify at least one outlier data point in the plurality of joined features, the identified at least one outlier data point indicating a probability of a failure of the transmission; receiving a result from the ADM, the result comprising the probability of the failure of the transmission; post-processing the result to generate a failure alert; and based on the generated failure alert, scheduling, within a remediation time window, a remediation procedure, the remediation time window being before a catastrophic failure of the transmission.

A twenty-second embodiment, which is a system for managing a maintenance schedule of an operational transmission, the system comprising: a reciprocating fracturing pump fluidically connected to a wellbore at a wellsite; the transmission having a plurality of planetary gears and being mechanically coupled at a first end to a power source of the reciprocating fracturing pump and mechanically coupled at a second end to crankshaft of the reciprocating fracturing pump; the transmission further being configured to transfer a power output from the power source to the reciprocating fracturing pump and the reciprocating fracturing pump configured to deliver a high-pressure fracturing fluid down the borehole; a plurality of spectrometers coupled to the transmission, each accelerometer of the plurality of accelerometers being configured to record a plurality of spectra; a data acquisition subsystem communicatively coupled to each accelerometer of the plurality of accelerometers, and further coupled to a data storage subsystem; a transmission maintenance scheduler of the reciprocating fracturing pump comprising a processor and a non-transitory memory, configured to: collect, using the data acquisition subsystem, each spectra of the plurality of spectra; feature processing the collected spectra to provide a plurality a plurality of joined features; input the plurality of joined features into an anomaly detection model (ADM), the ADM configured to identify at least one outlier data point in the plurality of joined features, the identified at least one outlier data point indicating a probability of a failure of the transmission; receive a result from the ADM, the result comprising the probability of the failure of the transmission; post-process, using a failure alert generator comprising a schedule generator and a schedule optimizer, the result to generate a failure alert; and based on the generated failure alert, schedule, using the schedule generator, a remediation procedure While embodiments have been shown and described, modifications thereof can be made by one skilled in the art without departing from the spirit and teachings of this disclosure. The embodiments described herein are exemplary only, and are not intended to be limiting. Many variations and modifications of the embodiments disclosed herein are possible and are within the scope of this disclosure. Where numerical ranges or limitations are expressly stated, such express ranges or limitations should be understood to include iterative ranges or limitations of like magnitude falling within the expressly stated ranges or limitations (e.g., from about 1 to about 9 includes, 2, 3, 4, etc.; greater than 0.10 includes 0.11, 0.12, 0.13, etc.). For example, whenever a numerical range with a lower limit, Rl, and an upper limit, Ru, is disclosed, any number falling within the range is specifically disclosed. In particular, the following numbers within the range are specifically disclosed: R=Rl+k*(Ru−Rl), wherein k is a variable ranging from 1 percent to 90 percent with a 1 percent increment, i.e., k is 1 percent, 2 percent, 3 percent, 4 percent, 5 percent, . . . 50 percent, 51 percent, 52 percent, . . . , 95 percent, 96 percent, 97 percent, 98 percent, 99 percent, or 90 percent. Moreover, any numerical range defined by two R numbers as defined in the above is also specifically disclosed. Use of the term "optionally" with respect to any element of a claim is intended to mean that the subject element is required, or alternatively, is not required. Both alternatives are intended to be within the scope of the claim. Use of broader terms such as comprises, includes, having, etc. should be understood to provide support for narrower terms such as consisting of, consisting essentially of, comprised substantially of, etc.

Accordingly, the scope of protection is not limited by the description set out above but is only limited by the claims which follow, that scope including all equivalents of the subject matter of the claims. Each and every claim is incorporated into the specification as an embodiment of the present disclosure. Thus, the claims are a further description and are an addition to the embodiments of the present disclosure. The discussion of a reference herein is not an admission that it is prior art, especially any reference that may have a publication date after the priority date of this application. The disclosures of all patents, patent applications, and publications cited herein are hereby incorporated by reference, to the extent that they provide exemplary, procedural, or other details supplementary to those set forth herein.

What is claimed is:

1. A system for managing a maintenance schedule of an operational transmission, the system comprising:

a reciprocating fracturing pump fluidically connected to a wellbore at a wellsite;

the transmission having a plurality of planetary gears and being mechanically coupled at a first end to a power source of the reciprocating fracturing pump and mechanically coupled at a second end to a crankshaft of the reciprocating fracturing pump;

the transmission further being configured to transfer a power output from the power source to the reciprocating fracturing pump and the reciprocating fracturing pump configured to deliver a high-pressure fracturing fluid down the borehole;

a plurality of accelerometers coupled to the transmission, each accelerometer of the plurality of accelerometers being configured to record a plurality of spectra;

a data acquisition subsystem communicatively coupled to each accelerometer of the plurality of accelerometers, and further coupled to a data storage subsystem; and a transmission maintenance scheduler of the reciprocating fracturing pump comprising a processor and a non-transitory memory, configured to:

collect, using the data acquisition subsystem, each spectrum of the plurality of spectra at a fixed time interval, each spectrum having a timestamp;

store the collected plurality of spectra in the data storage subsystem;

generate, using a spectra processor, from each spectrum of the plurality of spectra (a) statistical features of each spectrum and (b) characteristic frequency (CF) features of each spectrum;

using a timestamp filter, remove the statistical features and the CF features of each target spectrum of the plurality of spectra, each target spectrum having a timestamp corresponding to an idle time of the fracturing pump, and retain a plurality of processed features;

create, using a feature combiner module, a plurality of joined features by joining the plurality of processed features with a plurality of time domain (TD) features;

input the plurality of joined features into an anomaly detection model (ADM), the ADM configured to identify at least one outlier data point in the plurality of joined features, the identified at least one outlier data point indicating a probability of a failure of the transmission;

receive a result from the ADM, the result comprising the probability of the failure of the transmission;

post-process, using a failure alert generator comprising a schedule generator and a schedule optimizer, the result to generate a failure alert; and based on the generated failure alert, schedule, using the schedule generator, a remediation procedure.

2. The system of claim 1, wherein the schedule optimizer is further configured to:

rank the generated failure alert to produce a production impact score, the production impact score being based on a prediction of how much of a usable production time at the wellsite is lost during the remediation procedure, the usable production time being an amount of time when the wellsite is producing an oil, a gas, or another product in a paying quantity;

set a failure threshold, the failure threshold being a predefined threshold probability of an anomaly being present and the anomaly causing the failure of the transmission;

determine that a comparison of the production impact score and the failure threshold predicts that scheduling a remediation procedure increases the usable production time at the wellsite compared to an impact on the usable production time at the wellsite from the transmission experiencing a catastrophic failure; and confirm a date and a time of the scheduled remediation procedure, the remediation procedure comprising, in response to the comparison of the production impact score and the failure threshold, at least one of: changing an operating condition of the transmission, conducting a general repair of the transmission, or replacing the transmission.

3. The system of claim 1, wherein the ADM is a type of machine learning model selected to enhance an accuracy of the probability of failure of the transmission based on a deployment environment of the transmission, and wherein the failure alert of the transmission is displayed on a graphical display interface.

4. The system of claim 1, wherein the power source is an electric motor.

5. The system of claim 1, wherein the power source is a combustion engine.

6. The system of claim 1, wherein the plurality of accelerometers comprises a first accelerometer, a second accelerometer, a third accelerometer, a fourth accelerometer, and a fifth accelerometer.

7. The system of claim 6, wherein the first accelerometer and the second accelerometer are configured to record at least one spectrum of the plurality of spectra in a horizontal direction.

8. The system of claim 7, wherein the third accelerometer and the fourth accelerometer are configured to record at least one spectrum of the plurality of spectra in a vertical direction.

9. The system of claim 8, wherein the fifth accelerometer is configured to record at least one spectrum of the plurality of spectra in an axial direction.

10. The system of claim 9, wherein the plurality of planetary gears comprises a first planetary gear, a second planetary gear, a third planetary gear, and a fourth planetary gear.

11. The system of claim 1, wherein the fixed time interval is one second.

12. The system of claim 1, wherein the statistical features are associated with a measured state of the transmission.

13. The system of claim 12, wherein the CF features are associated with a likelihood of a presence of CFs, the CFs being generated by a meshing of the plurality of planetary gears and indicating a likelihood of failure of the transmission.

14. The system of claim 1, wherein the statistical features of each spectrum further comprise a mean, a median, a variance, a standard deviation, a kurtosis, a skewness, a root mean square (RMS) value, a crest factor, a frequency center, and a root mean square (RMS) frequency.

15. The system of claim 1, wherein post-processing the result comprises generating the failure alert based on a number of times each joined feature in the plurality of joined features exceeds a predefined threshold of anomaly probability associated with each joined feature.

16. The system of claim 1, wherein the ADM is a type of machine learning model selected to enhance an accuracy of the probability of failure of the transmission based on a deployment environment of the transmission.

17. The system of claim 1, wherein the schedule optimizer is configured to rank the generated failure alert to produce a production impact score, wherein the production impact score is based on a prediction of how much of a usable production time at the wellsite is lost during the remediation procedure, and wherein the usable production time is an amount of time when the wellsite is producing an oil, a gas, or another product in a paying quantity.

18. The system of claim 17, wherein the schedule optimizer is further configured to set a failure threshold, wherein the failure threshold is a predefined or a tunable threshold probability of an anomaly being present and the anomaly causing the failure of the transmission.

19. The system of claim 18, wherein the schedule optimizer is further configured to determine that a comparison of the production impact score and the failure threshold predicts that scheduling the remediation procedure increases the usable production time at the wellsite compared to an impact on the usable production time at the wellsite from the transmission experiencing a catastrophic failure.

20. The system of claim 1, wherein the statistical features are associated with a measured state of the transmission, and wherein the CF features are associated with a likelihood of a presence of CFs, the CFs being generated by a meshing of the plurality of planetary gears and indicating a likelihood of failure of the transmission.

* * * * *